US007552499B2

(12) United States Patent
James et al.

(10) Patent No.: US 7,552,499 B2
(45) Date of Patent: Jun. 30, 2009

(54) MULTI-PURPOSE CLEANING IMPLEMENT

(75) Inventors: Adrian Benton James, Palo Alto, CA (US); Bryan Thomas White, Fremont, CA (US); Michael Joseph Shawver, Pleasanton, CA (US); Jan Hendrik Maria Verbiest, Baruta (VE); Virginia Pankratz, Cincinnati, OH (US); Paulus Antonius Augustinus Höfte, Sint Martens Latem (BE)

(73) Assignee: The Procter & Gamble Company, Cincinnati, OH (US)

( * ) Notice: Subject to any disclaimer, the term of this patent is extended or adjusted under 35 U.S.C. 154(b) by 308 days.

(21) Appl. No.: 10/934,852

(22) Filed: Sep. 3, 2004

(65) Prior Publication Data

US 2005/0060827 A1 Mar. 24, 2005

Related U.S. Application Data

(60) Provisional application No. 60/499,852, filed on Sep. 3, 2003, provisional application No. 60/562,000, filed on Apr. 13, 2004.

(51) Int. Cl.
*A47L 13/20* (2006.01)

(52) U.S. Cl. ..... 15/144.2; 15/228; 15/231; 15/97.1

(58) Field of Classification Search ..... 15/228, 15/144.2, 231
See application file for complete search history.

(56) References Cited

U.S. PATENT DOCUMENTS

| | | | | |
|---|---|---|---|---|
| 4,225,998 | A * | 10/1980 | Thielen | 15/231 |
| 6,260,226 | B1 * | 7/2001 | Specht | 15/119.1 |
| 2004/0010877 | A1 * | 1/2004 | Jackson | 15/176.6 |

FOREIGN PATENT DOCUMENTS

EP 0 390 430 A 10/1990

OTHER PUBLICATIONS

International Search Report, PCT/US2004/028738, 2 pages.

* cited by examiner

*Primary Examiner*—Shay L Karls
(74) *Attorney, Agent, or Firm*—Thabault Fayette; Julia A. Glazer; Amy I. Ahn-Roll

(57) ABSTRACT

A cleaning implement is provided for cleaning surfaces with a cleaning substrate. The cleaning implement includes a handle connected via a universal joint to a mop head. A portion of the universal joint forms a handgrip which allows a user to hold the mop head independently from the handle. The cleaning implement has a quick-disconnect mechanism which includes a male element located at a distal end of the handle and a female element located on the universal joint and which allow a user to easily disconnect the handle from the mop head.

29 Claims, 19 Drawing Sheets

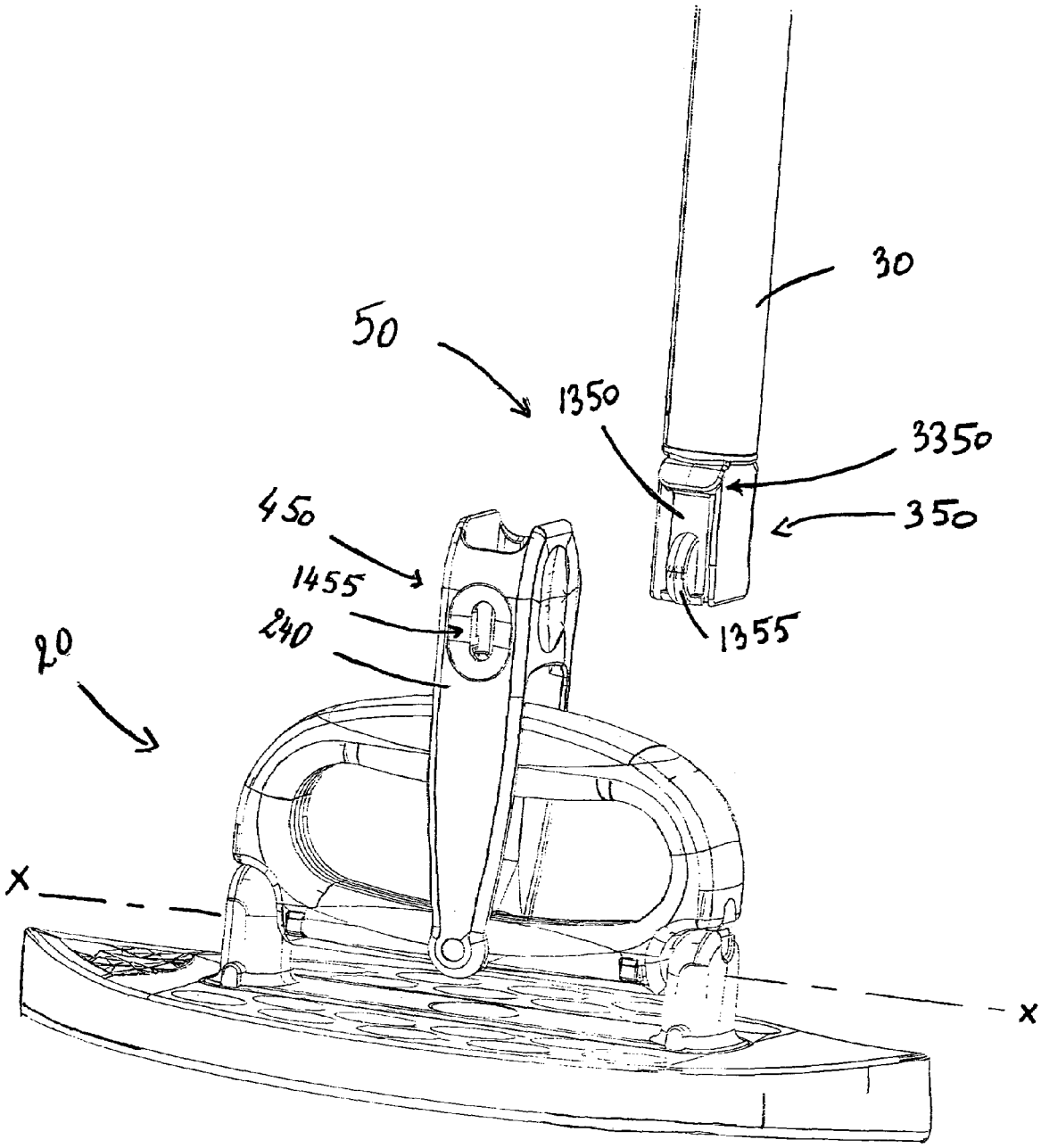
FIG. 10
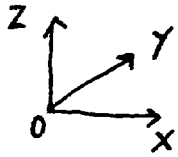

MULTI-PURPOSE CLEANING IMPLEMENT

TECHNICAL FIELD OF THE INVENTION

The present invention relates to the field of cleaning implements, and, more particularly, to the field of multi-purpose cleaning implements useful for cleaning hard surfaces such as floors, sinks, bathtubs, shower walls and the like.

BACKGROUND OF THE INVENTION

The literature is replete with products capable of cleaning hard surfaces such as ceramic tile floors, hardwood floors, counter tops and the like. In the context of cleaning floors, and in particular in the context of cleaning floors with a cleaning substrate, numerous devices are described comprising an elongated handle rotatably connected to a mop head via a universal joint. One example of such an implement is the SWIFFER® cleaning implement. In order to clean the surface, a user attaches a disposable dry cleaning sheet, such as a SWIFFER® cleaning sheet, or a disposable absorbent cleaning wipe or pad, such as a SWIFFER WET® pre-moistened cleaning pad, to the mop head of the implement and then wipe the surface with the chosen cleaning substrate. The universal joint allows the mop head to swivel in the direction desired by the user, but in addition, it allows the handle to pivot relative to the mop head and, as a result, it allows the user to clean hard to reach surfaces such as underneath a table, a sofa or any other type of furniture. This type of cleaning implement is sized such that it is usually used to clean relatively large surfaces.

A user can clean smaller surfaces either by holding the cleaning substrate in his or her hand and then wipe the surface to be cleaned. In order to minimize direct contact between the user's hand and the cleaning substrate, one can also use a different type of implement such as a SWIFFER DUSTER®, which includes a handle designed to receive a disposable cleaning substrate. The handle of this implement is sized such that it can be held with one hand and can be used to clean stairs, shelves or tables.

It can be appreciated that a user must own two different kinds of cleaning implements in order to clean surfaces conveniently depending on the size and type of surface to be cleaned.

It is therefore one object of this invention to provide a cleaning implement which can be used with an elongated handle in order to clean large surfaces or can be held by a user's hand when needed.

SUMMARY OF THE INVENTION

In one embodiment, the invention relates to a cleaning implement for use with a cleaning substrate, which includes a mop head, a universal joint rotatably connected to the mop head and having a first and a second rotational axis where the universal joint comprises a handgrip portion and a handle connected to the universal joint.

In another embodiment, the invention also relates to cleaning implement for use with a disposable cleaning substrate which includes a mop head, a universal joint having a first and a second rotational axis, where the universal joint is connected to the mop head and an elongated handle having a proximal and a distal end, where the distal end comprises a male element for releasably engaging a female element of the universal joint.

In another embodiment, the invention relates to a cleaning implement for cleaning a surface which includes a mop head, a first handle segment operably connected to the mop head, a second handle segment operably connected to the first handle segment, where the first handle segment is slideably movable within the second handle segment, and a clinch-lock mechanism for controllably locking the first handle segment relative to the second handle segment.

In another embodiment, the invention relates to a cleaning implement for use with a cleaning substrate which includes a mop head, a first handle segment having a proximal and a distal end, where the distal end is operably connected to the mop head, a second handle segment where at least a portion of the first handle segment is slideably movable within the second handle segment, and a locking mechanism for controllably locking the first handle segment relative to the second handle segment, where the first handle segment and the second handle segment have an elliptical cross-sectional shape.

In another embodiment, the invention relates to a cleaning kit for cleaning a surface which includes a package, and a cleaning implement stored in this package, the cleaning implement includes a mop head, a first handle segment which is connectable to the mop head when the cleaning implement is removed from the package, a second handle segment which is connectable to the first handle segment when the cleaning implement is removed from the package, a third handle segment, wherein at least a portion of the second handle segment is located within the third handle segment when the cleaning implement is stored in the package, a fourth handle segment which is connectable to the third handle segment when the cleaning implement is removed from the package, and at least one disposable cleaning substrate.

In another embodiment, the invention relates to a cleaning kit for cleaning a surface which includes a package, and a cleaning implement stored in the package and comprising a mop head, wherein the package comprises a box and a retaining element located inside this box, where the three-dimentional shape of the retaining element conforms to at least a portion of the mop head such that movement of the mop head within the package is substantially prevented when at least a portion of the mop head is placed within the conforming three-dimensional shape of the inner maintaining member.

In anotherr embodiment, the invention relates to a cleaning implement for use with a cleaning substrate, comprising a mop head, a universal joint connected to the mop head and having a first and a second rotational axis wherein the universal joint comprises a rotation-tempering mechanism and a handle connected to the universal joint.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

FIG. 10 is an isometric view of another embodiment of a cleaning implement where the handle is disconnected from the mop head;

DETAILED DESCRIPTION OF THE PREFERRED EMBODIMENTS

Figure 1:
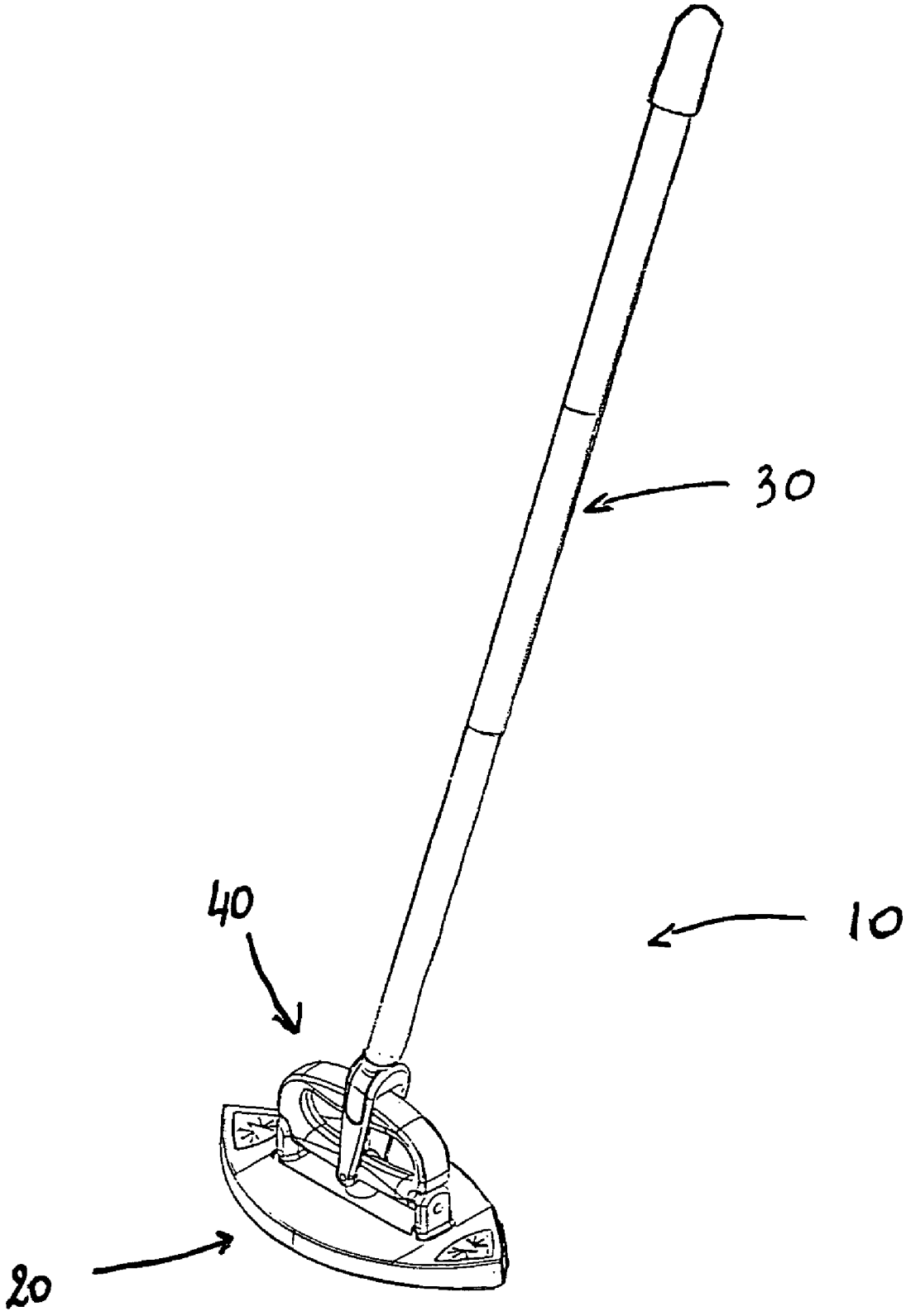
FIG. 1 is an isometric view of a cleaning implement of one embodiment of the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

As discussed more fully hereafter, the present invention is, in its most preferred form, directed to a cleaning implement having a mop head with retaining members for securing a cleaning substrate about the mop head during the cleaning operation. While the present invention is discussed herein with respect to a cleaning implement for purposes of simplicity and clarity, it will be understood that the present invention can be used with a cleaning implement having a mop head having a different shape and/or size.

Referring to FIG. 1, a cleaning implement 10 made in accordance with the present invention is illustrated.

In one embodiment, the cleaning implement 10 comprises a mop head 20, a handle 30 which is rotatably connected to the mop head 20 by a universal joint 40. By "elongated handle", it is meant a handle whose length is at least about 20 cm, preferably at least about 65 cm, more preferably at least about 115 cm.

Figure 2:
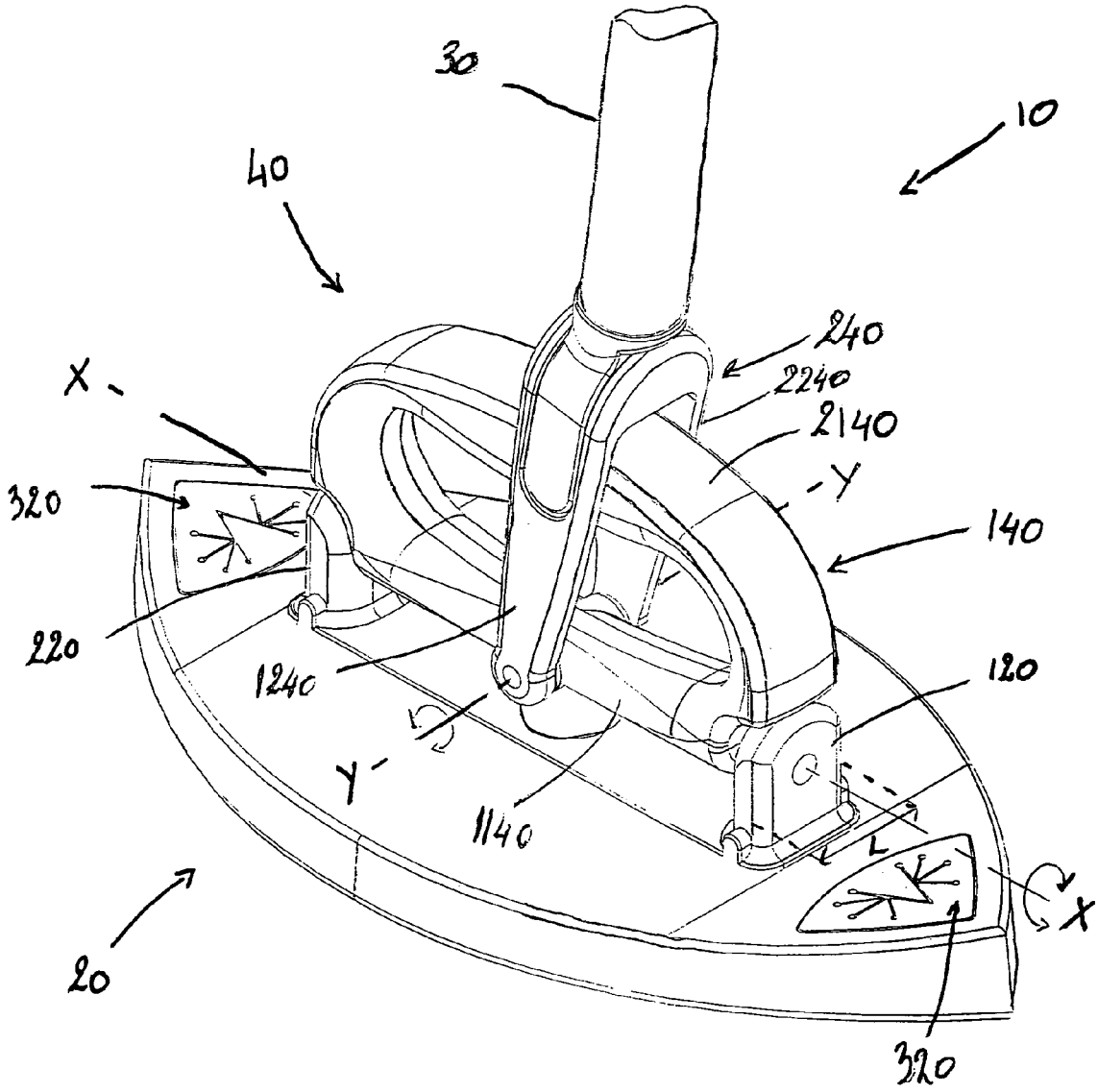
FIG. 2 is an enlarged view of the mop head of the cleaning implement shown in FIG. 1.

FIG. 2 shows an enlarged view of the mop head 20, the universal joint 40 and the lower portion of the handle 30.

I. Universal Joint.

In one embodiment, the universal joint 40 comprises a lower member 140 which is rotatably connected to the mop head 20 about a rotational axis X-X. In a preferred embodiment, the lower member 140 is rotatably connected via pins (not shown) to a first and a second protrusion 120 and 220 which are both fixedly connected to the mop head 20. In a preferred embodiment, the lower member 140 can rotate freely of about 180° relative to the mop head 20 but one skilled in the art will understand that the angle of rotation can be smaller or greater and still provide the same benefits.

In a preferred embodiment, the lower member 140 is ergonomically shaped to form a handgrip. By "ergonomically shaped to form a handgrip", it is meant any shape which allows a user to hold the lower member 140 with one hand. In one embodiment, the lower member 140 includes a support portion 1140 connected to a handgrip portion 2140. One skilled in the art will understand that the handgrip portion 2140 and the support portion 1140 define a space 2145 which allows a user to insert his or her fingers in order to hold the handgrip portion 2140.

In one embodiment, the universal joint 40 comprises an upper member 240 that is rotatably connected to the lower member 140 about a rotational axis Y-Y. In a preferred embodiment, the upper member 240 is rotatably connected to a middle portion of the lower member 140. In a preferred embodiment, the upper member 240 comprises at least one, but preferably two leg portions 1240 and 2240 which is (are) rotatably connected to the support portion 1140 of the lower member 140 via a pin (not shown) such that the lower member 140 is located in between the first and second leg portions 1240 and 2240. In a preferred embodiment, the upper member 240 can rotate freely of about 180° relative to the lower member 140 but one skilled in the art will understand that the angle of rotation can be smaller or greater and still provide the same benefits. In a preferred embodiment, the rotational axis Y-Y is substantially perpendicular to the rotational axis X-X. One skilled in the art will understand that the two rotational axes X-X and Y-Y allow the mop head to swivel in the direction desired by the user and that it also allows a user to incline the handle 30 relative to the mop head 20 at a "sharp" or pronounced angle in order to reach and clean underneath furniture.

In one embodiment, the cleaning implement 10 comprises a "rotation-tempering" mechanism. By "rotation-tempering mechanism", it is meant any mechanism capable of limiting the ability of the universal joint to rotate freely about at least one of its rotational axis.

Figure 3A:
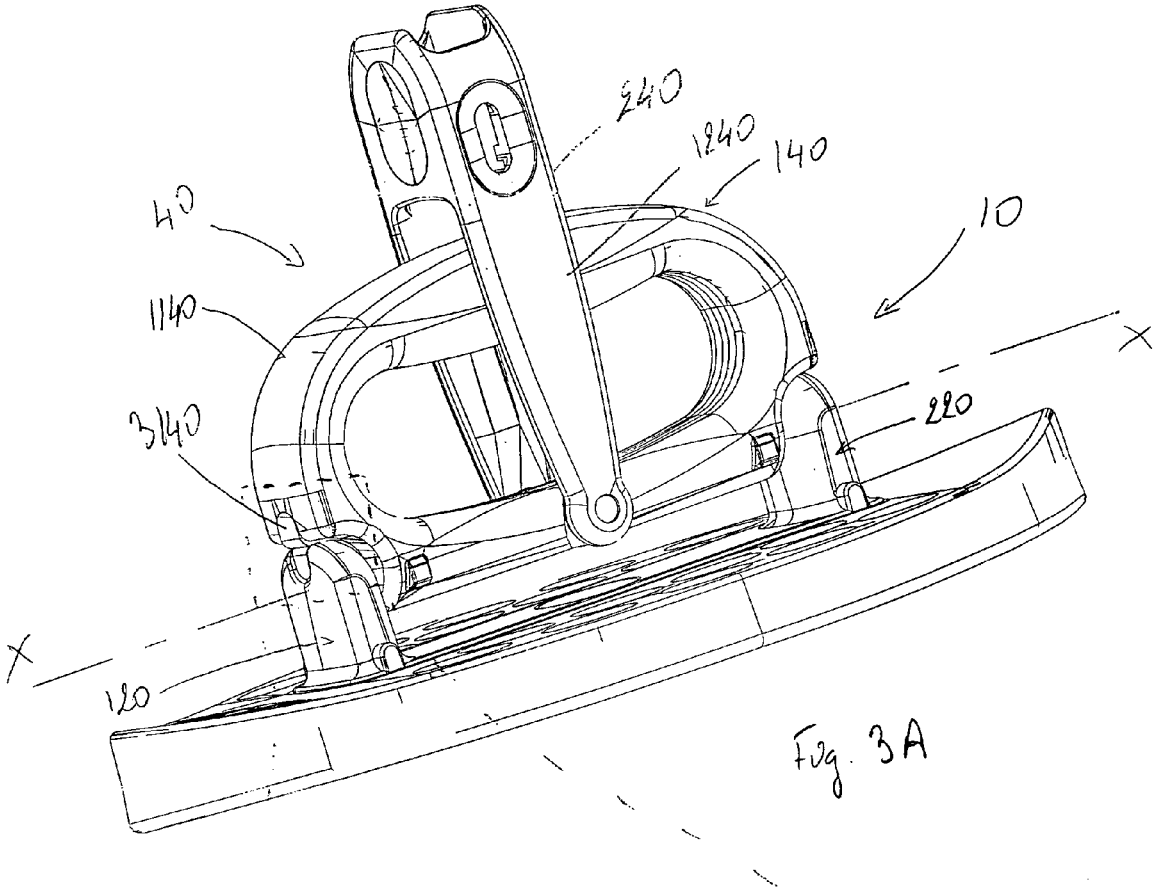
FIG. 3A is an isometric view of a cleaning implement having a "rotation-tempering" mechanism.
Figure 3B:
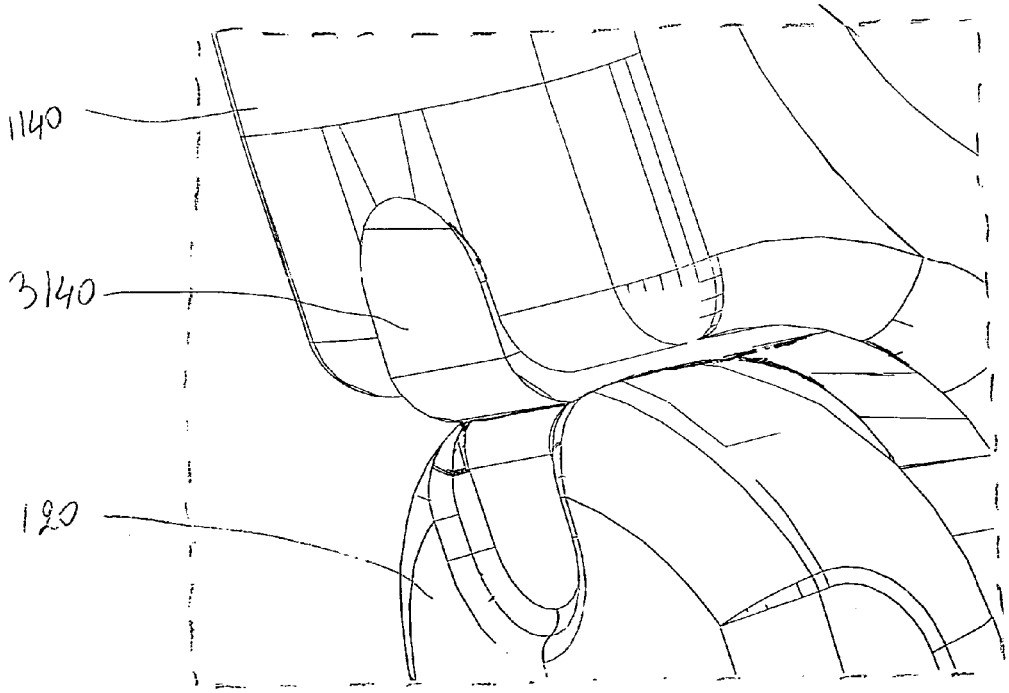
FIG. 3B is an enlarged view of a portion of FIG. 3A.

In one embodiment shown in FIGS. 3A and 3B, the "rotation tempering" mechanism comprises at least one frictional element 3140 which is part of the lower member 140 of the universal joint 40. The frictional element 3140 can be attached to the handgrip portion 2140 such that the frictional element 3140 frictionally contacts, and preferably rubs against, a portion of the first protrusion 120 when the lower member rotates about the X-X rotational axis. In a preferred embodiment, the lower member 140 includes a second frictional element 3140 which can be attached to the handgrip portion 2140 such that the frictional element 3140 frictionally contacts, and preferably rubs against, the second protrusion 220 when the lower member rotates about the X-X rotational axis. One skilled in the art will understand that the frictional element(s) in contact with the protrusion(s) 120 and/or 220 generate a resistive force limiting the ability if the universal joint to rotate about the X-X rotational axis. It will be understood that alternatively, the frictional element(s) 3140 can be connected to the protrusion(s) 120 and/or 220 and frictionally contact the lower member 140 of the universal joint 40 and still provide the same benefits.

Figure 4:
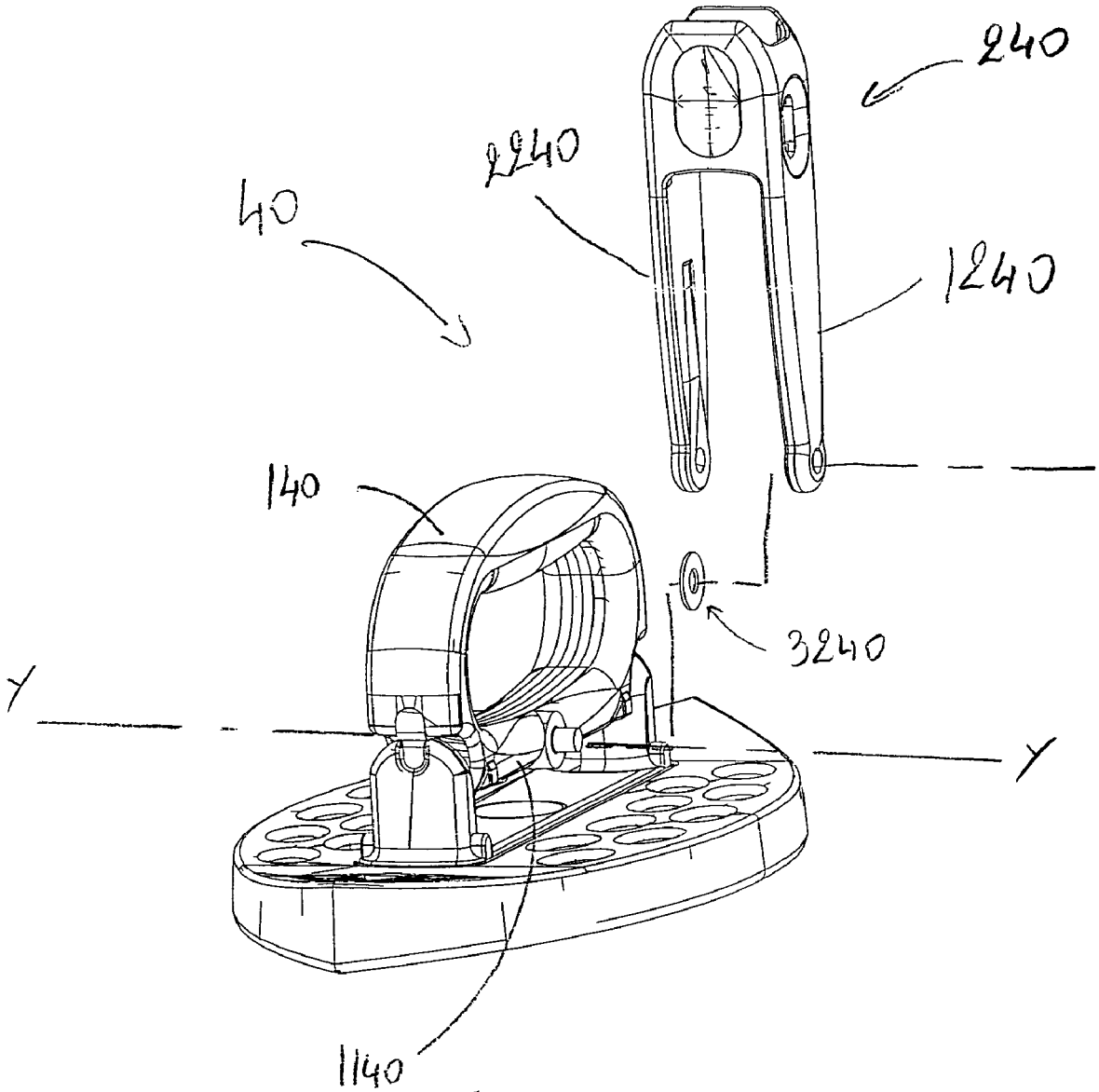
FIG. 4 is another isometric view of the implement of FIG. 3A

In one embodiment shown in FIG. 4, the "rotation tempering" mechanism comprises a friction enhancing washer 3240 located in between the upper member 240 of the universal joint 40 support portion 1140 of the lower member 140. In one embodiment, the universal joint 40 includes at least one, but preferably two frictional elements 3240 which frictionally contact, and preferably rub against, at least one of the leg portions 1240 or 2240 and the support portion 1140 of the lower member 140 when the upper member rotates about the Y-Y rotational axis.

The friction elements 3140 and/or 3240 can be in the form of bushing or washer.

The frictional element(s) 3140 and the frictional elements 3240 can be made of any material having a greater coefficient of friction than the upper, lower and protrusions elements forming the universal joint. Non-limiting examples of suitable materials include Natural or synthetic rubbers, silicon materials, thermoplastic olefins, Thermoplastic Vulcanizates like Vyram® or thermoplasrtic elastomers like Santoprene® styrenic thermoplastic materials such as SBS and SEBS. The frictional element(s) 3140 and the frictional elements 3240 can be made of any material which is "softer" (i.e. having a lower durometer) than the material used to make than the upper, lower and protrusions elements forming the universal joint. Alternatively, the protrusions 120, 220 and or the lower member 140 and/or the upper member can be made of a material providing the desired amount of friction.

Among other benefits, the "rotation-tempering" mechanism prevents the mop head from flopping or tilting when the implement is used to clean vertical walls while a user applies pressure on the handle either in an upward or downward motion.

It will be understood that while the "rotation-tempering" mechanism limits or reduces the ability of the universal joint to rotate about at least one of its rotational axis, a user is still able to maneuver and direct the mop head by rotating the handle. Consequently, the "rotation-tempering" mechanism provides better directional control of the mop head during the cleaning operation.

In one embodiment, the minimum torque that a user needs to overcome in order to have the handle rotate about at least one of the rotational axis is between about 0.0005 Nm and about 0.1 Nm, preferably between about 0.001 Nm and about 0.09 Nm, more preferably between about 0.005 Nm and 0.05 Nm.

The minimum torque that a user needs to overcome in order to rotate the handle about one rotational axis can be measured as follows:

The mop head of a cleaning implement having a "rotation-tempering" mechanism is held such that the rotational axis is substantially parallel to a horizontal plane and the handle of the implement is substantially perpendicular to the horizontal plane.

A reference point is marked on the handle and the vertical distance between this reference point and the rotational axis (i.e. height) is measured.

A force substantially perpendicular to the rotational axis is applied to the reference point via a gauge.

The force is increased until the handle starts rotating.

When the handle starts rotating about the rotational axis, the force is read on the gauge and recorded.

The minimum torque is then equal to the force previously recorded (in Newton) multiplied by the distance (in meter) between the reference point and the rotational axis.

The same experiment can be conducted for any other rotational axis of the universal joint.

In one embodiment, the universal joint is connected to the mop head such that one of its rotational axis is substantially parallel to the longitudinal axis of the mop head (i.e. length wise) and the other rotational axis is substantially perpendicular to the longitudinal axis of the mop head.

In one embodiment, the minimum torque that a user needs to overcome in order to have the handle rotate about one of the rotational axis that is substantially parallel to the longitudinal axis of the mop is between about 0.0005 Nm and about 0.1 Nm, preferably between about 0.001 Nm and about 0.09 Nm, more preferably between about 0.005 Nm and 0.05 Nm. In one embodiment, the minimum torque that a user needs to overcome in order to have the handle rotate about one of the rotational axis that is substantially perpendicular to the longitudinal axis of the mop head is between about 0.0005 Nm and about 0.1 Nm, preferably between about 0.001 Nm and about 0.09 Nm, more preferably between about 0.005 Nm and 0.05 Nm.

Figure 5:
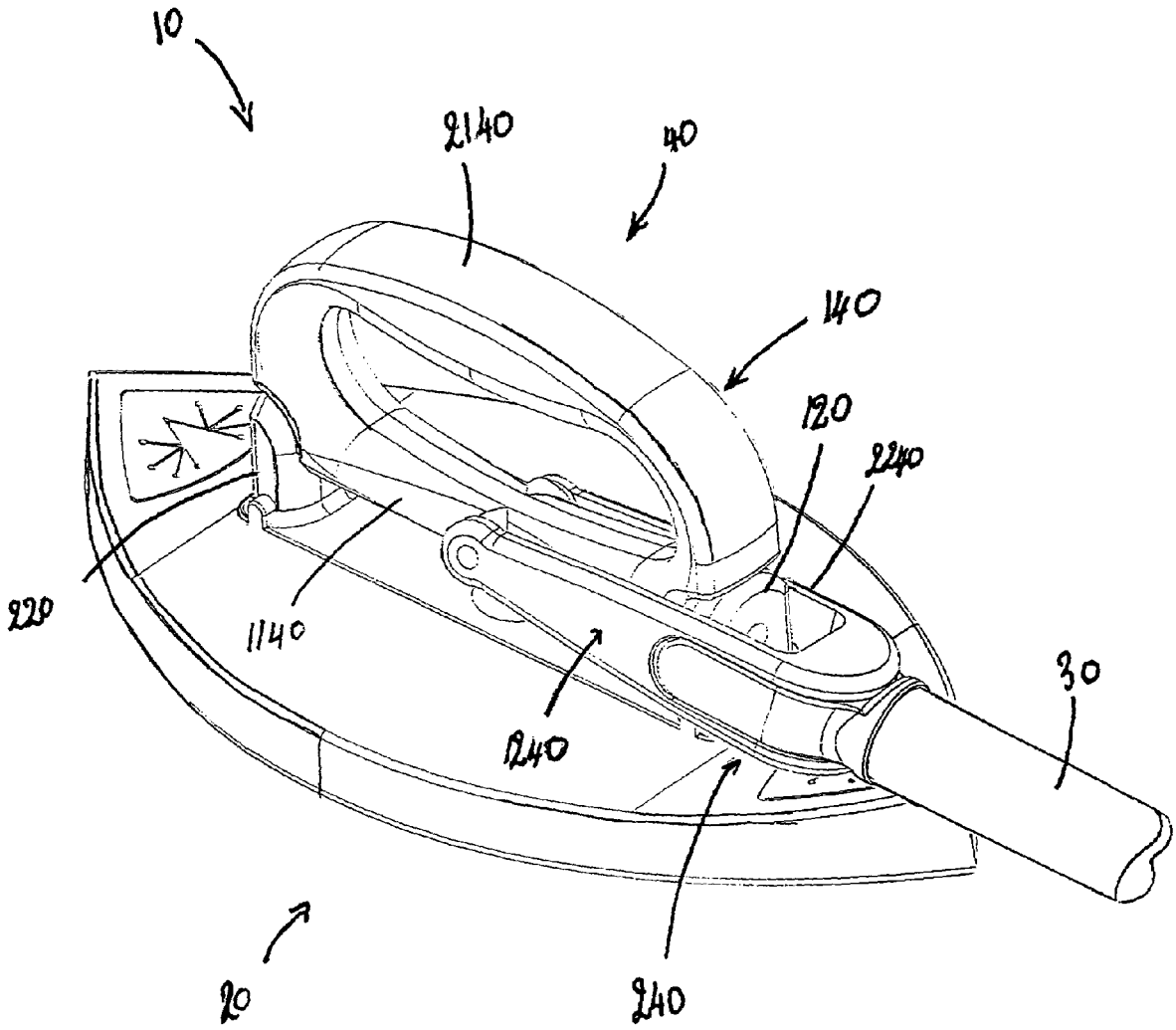
FIG. 5 is an isometric view of the implement of FIG. 2 where the universal joint is in the locked position.

In one embodiment, the length L of the first and second protrusions 120 and 220 is smaller than the inner distance between the first and second leg portions 1240 and 2240. One skilled in the art will understand that when the lower member 140 is "aligned" with the first and second protrusions 120 and 220 (as shown in FIG. 2), the upper member 240 can rotate about the rotational axis Y-Y until one of the protrusions 120, 220 is located in between the first and second leg portion 1240 and 2240 as shown in FIG. 5. In this position, the first and/or second leg portions 1240 and 2240 prevent rotation of the lower member 140 about the X-X axis. In addition, when one of the protrusions 120, 220 is located in between the first and second leg portion 1240 and 2240, a user can grab the grip portion 2140 with one hand.

In one embodiment, the universal joint 40 is temporarily lockable relative to the mop head 20. In a preferred embodiment, the upper member 240 is temporarily lockable relative to one of the first or second protrusions 120, 220 such that the lower member 140 cannot rotate about the X-X axis and that the upper member 240 cannot rotate about the axis Y-Y. By "temporarily lockable" with regard to a universal joint, it is meant that during the cleaning operation, when the upper member 240 is locked, the lower and uppers members 140, 240 cannot rotate about the rotational axes X-X and Y-Y until the user applies enough force to unlock the upper member 240 (i.e. pull the upper member 240 upwards).

In a one embodiment, the length of at least a portion of one or both of the protrusions 120 and 220 is slightly greater than the inner distance between the first and second leg portions 1240 and 2240. One skilled in the art will understand that in this embodiment, the upper member 240 can be "force-fitted" or "friction-fitted" against at least one of the protrusions 120, 220 when a user pushed the upper member 240 against the protrusion which length is slightly greater than the inner distance between the two leg portions 1240 and 2240. In a preferred embodiment, the length L of at least a portion of both the first and second protrusions is slightly greater than the inner distance between the first and second leg portions 1240 and 2240. One skilled in the art will understand that in this embodiment, the upper member 240 is temporarily lockable relative to either the first or second protrusions 120, 220. Among other benefits, this embodiment provides greater convenience to the user who can temporarily lock the universal joint 40 by pushing the upper member 240 against either the first or second protrusion 120, 220 and then grab the grip portion 2140 of the lower member 140.

Figure 6:
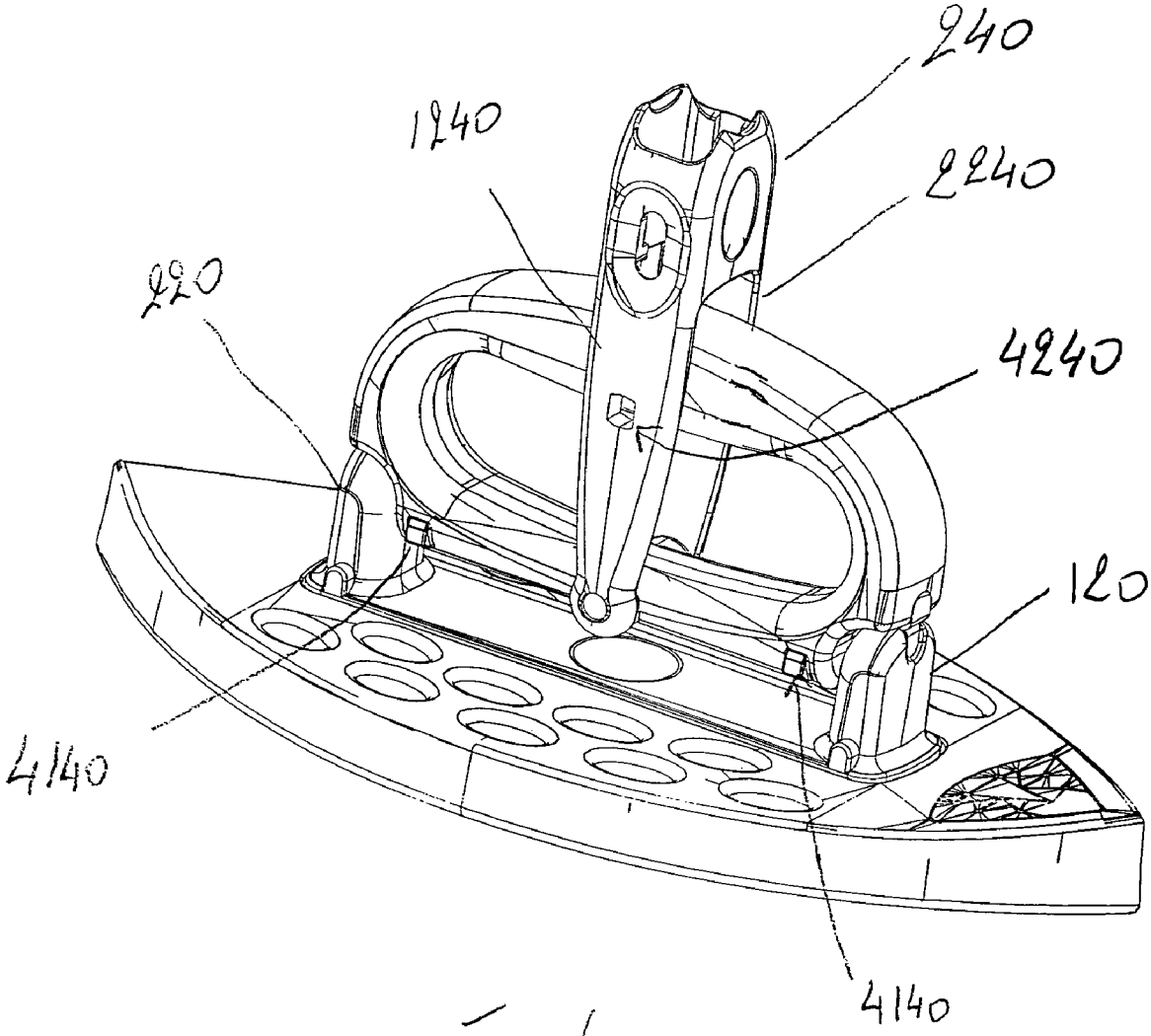
FIG. 6 is an isometric view of a cleaning implement having a locking mechanism according to one embodiment of the invention.

In a one embodiment shown in FIG. 6, the length of at least one or both of the protrusions 120 and 220 can be less than the inner distance between the first and second leg portions 1240 and 2240. In this embodiment, at least one, but preferably both leg members 1240, 2240 includes a recess extending from the inner surface toward the outer surface of the leg members. In a preferred embodiment, at least one, but preferably both leg members 1240, 2240 includes an opening 4240 made through the leg member(s). The recess or opening 4240 can be engaged by a corresponding projection 4140 located on the lower member 140, preferably located on the support portion 1140. In a preferred embodiment, the support portion 1140 includes at least two projections 4140 symmetrically located relative to the rotational axis Y-Y. One skilled in the art will understand that when the lower member 140 is aligned with the protrusions 120, 220, the upper member can rotate until the projection(s) 4140 engages a corresponding recess or opening 4240. When a projection 4140 engages a recess or opening 4240, the universal joint is temporarily locked until a user applies enough force to cause the projection to disengage the recess or opening. One skilled in the art will also understand that the projection 4140 can be located on the support potion 1140 and the recess or opening 4240 can be located on the leg members 1240 and still provide the same benefits.

The previously described universal joint including a handgrip that is temporarily lockable allows not only the user to hold the mop head with one hand in order to clean small surfaces but it also allows the user to apply more force at specific portions of the mop head. It can be particularly beneficial to control the amount of force applied to the mop head especially when the mop head has an "eye" shape and the mop head includes a deformable bumper pad as described in copending U.S. provisional patent application Ser. No. 60/499,851 to Goh et al., filed Sep. 3, 2003, and assigned to The Procter & Gamble Company.

II Quick Disconnect Mechanism.

In one embodiment, the handle 30 is releasably connected to the universal joint 40. Among other benefits, a handle releasably connected to the universal joint 40 allows a user to use the cleaning implement in combination with the handle 30, in particular when he or she wishes to clean large surfaces, and it also allows a user to remove the handle 30 and grab the handgrip portion 2140 in order to clean smaller surfaces as previously discussed. In addition, a handle 30 releasably connected to the universal joint 40 allows a user to use the same handle with different mop heads (for example, having different sizes or functionalities) or vice versa, it allows the user to use the previously described mop head with another handle. In addition, a handle releasably connected to the universal joint 40 allows a user to replace damaged mop heads or/or handles for new ones.

In a preferred embodiment, the lower portion or distal end of the handle 30 is releasably connected to the upper member 240 of the universal joint 40. It is contemplated that the handle 30 can be releasably connected to the universal joint via any mechanisms know in the art and still provide at least some of the same benefits. Non-limiting examples of mechanism suitable for releasably connecting the handle to the universal joint include screws and screw threads, magnets, spring-clip mechanisms, friction fit prong mechanisms, and bayonet mechanisms. Non-limiting examples of suitable connection mechanism are also described in U.S. patent application Ser. No. 10/172,619 to Streutker et al., filed Jun. 14, 2002, and assigned to The Procter & Gamble Company.

In one embodiment shown in FIGS. 7-11, the cleaning implement 10 comprises a quick-disconnect mechanism 50 for releasably connecting the lower portion of the handle 30 to the upper member 240 of the universal joint 40.

Figure 7:
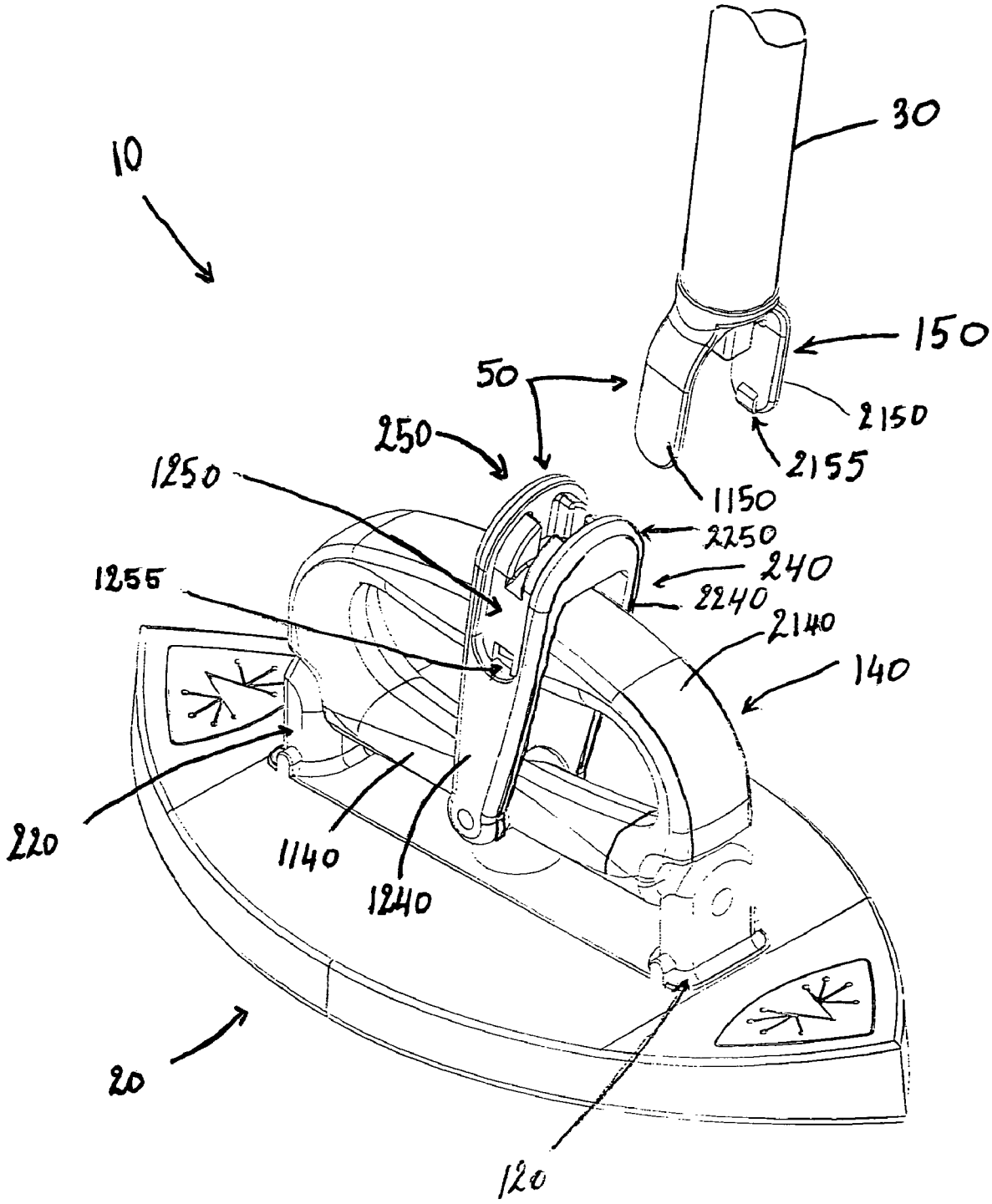
FIG. 7 is an isometric view of the implement of FIG. 2 where the handle is disconnected to the mop head.
Figure 8:
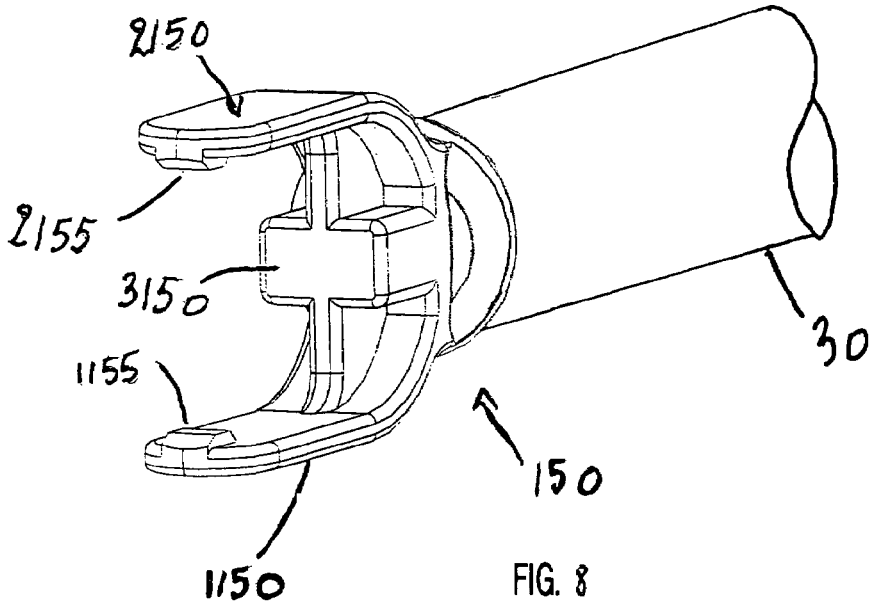
FIG. 8 is an isometric view of the lower portion of the handle shown in FIG. 4.
Figure 9:
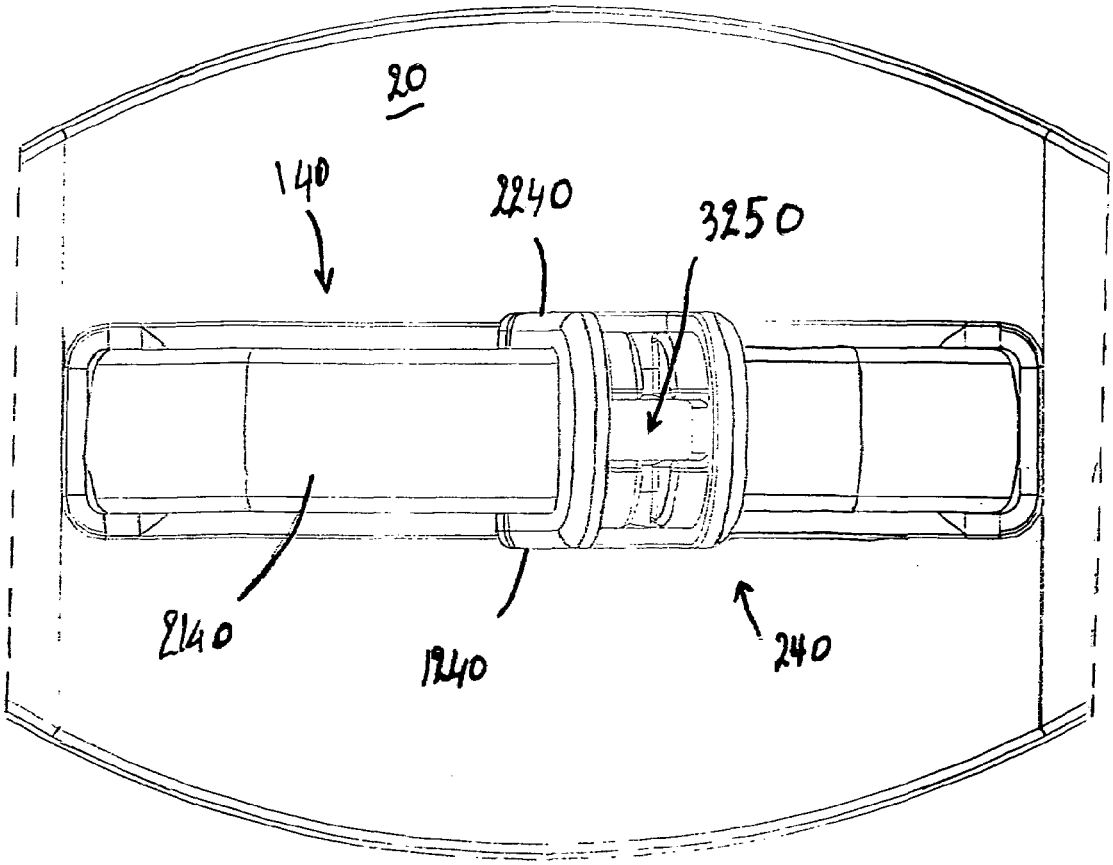
FIG. 9 is a partial top view of the implement of FIG. 4.

In one embodiment shown in FIGS. 7-9, the quick-disconnect mechanism 50 comprises a male element 150 connected to or formed with the lower portion of the handle 30 and a female element 250 connected to or formed with the upper member 240. In one embodiment, the male element 150 comprises at least one but preferably two side portions 1150 and 2150 with a space in between. The two side portions 1150 and 2150 are capable of sliding along corresponding notched portions 1250 and 2250 of the female element 250. In one embodiment, the side portion(s) 1150 and/or 2150 include at least one but preferably two projections 1155 and/or 2155 extending inwardly from the inner surface of the side portions 1150. The projections 1155 and/or 2155 are capable of engaging corresponding recesses 1255 or 2255 located within the notched portions 1250 and 2250. When a user wishes to connect the handle 30 to the universal joint 40, he or she can simply push the side portions 1150 and 2150 of the male element 150 along the notched portions 1250 and 2250 of the female element 250 until the projections 1155 and 2155 engage the corresponding recesses 1255 and 2255. In a preferred embodiment, the male element 150 is made of a resilient material such that the side portions 1150 and 2150 are deflected outwardly while the side portions slide within the notched portions and such that it recover its original shape when the projections 1155 and 2155 engage the recesses 1255 and 2255. In addition, the material resiliency is such that a user can easily connect and disconnect the handle to the universal joint but also such that the handle is not disconnected from the universal joint during the mopping of a surface with the cleaning implement. Non-limiting examples of suitable material include wood, metals, and plastics. One skilled in the art will understand that when the handle is connected to the universal joint, the projections/recesses prevent at least temporarily the longitudinal movement of the handle relative to the female element and that the side portions/notched portions prevent the rotation of the handle relative to the female element.

In a preferred embodiment, the male element 150 comprises a central projection 3150 for engaging a corresponding central recess 3250 of the female element 250. The central projection 3150 and the central recess 3250 further prevent the longitudinal and/or rotational movement of the male element 150 relative to the female element 250. The central projection 3150 can have any cross-sectional shape such as rectangular, circular, triangular, X shape, star shape or any combinations thereof.

FIG. 10 shows an enlarged perspective view of another embodiment of the quick-disconnect mechanism 50 which comprises a male element 350 connected to or formed with the lower portion of the handle 30 and a female element 450 connected to or formed with the upper member 240.

Figure 11:
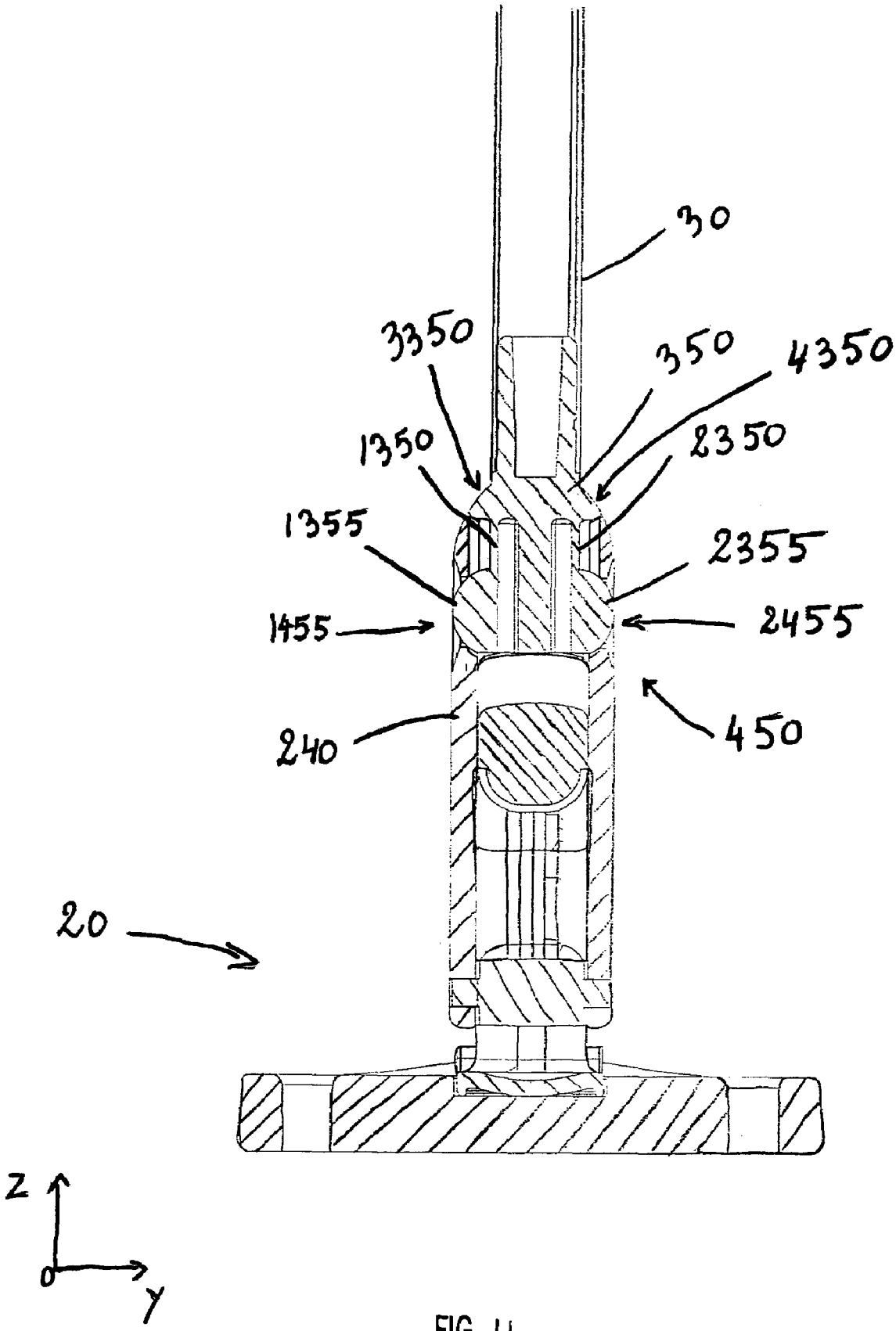
FIG. 11 is a cross-sectional view of the implement of FIG. 7 taken in the (y,z) plane.
Figure 12:
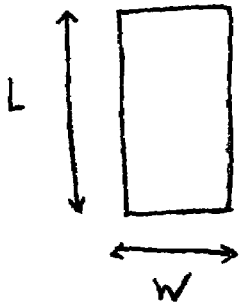
FIG. 12 is a cross-sectional view of a suitable handle.
Figure 13:
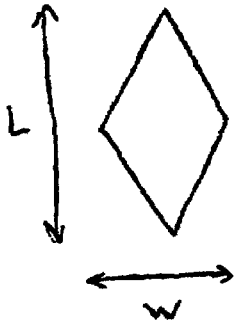
FIG. 13 is a cross-sectional view of another suitable handle.
Figure 14:
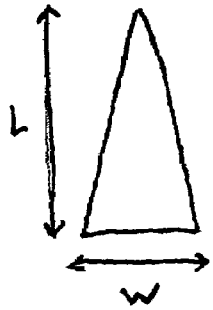
FIG. 14 is a cross-sectional view of another suitable handle.

FIG. 11 shows a cross-sectional view of the quick-disconnect mechanism shown in FIG. 10 taken in the (y,z) plane.

In one embodiment, the male element 350 comprises at least one but preferably two side portions 1350 and 2350 with a space in between. The two side portions 1350 and 2350 can be inserted within the female element 450 through an opening 1450 made in the top portion of the upper member 240. In one embodiment, the side portion(s) 1350 and/or 2350 include at least one but preferably two projections 1355 and/or 2355 extending outwardly from the outer surface of the side portions 1350 and 2350. The projections 1355 and/or 2355 are capable of engaging and are preferably capable of extending through corresponding openings 1455 or 2455 of the female element 450. When a user wishes to connect the handle 30 to the universal joint 40, he or she can simply insert the male element 350 and its side portions 1350 and 2450 within the female element 450 through the opening 1450 until the projections 1355 and 2355 engage and preferably extend beyond the corresponding openings 1455 and 2455.

In a preferred embodiment, the side portions 1350 and 2350 of the male element 150 are made of a resilient material such that the side portions 1150 and 2150 are deflected inwardly when the side portions are inserted within the female element 450 and such that it recover its original shape when the projections 1355 and 2355 engage the openings 1455 and 2455. In addition, the material resiliency is such that a user can easily connect and disconnect the handle to the universal joint but also such that the handle is not disconnected from the universal joint during the mopping of a surface with the cleaning implement. One skilled in the art will appreciate that when the projections 1355 and 2355 extend beyond the corresponding openings 1455 and 2455, a user can easily disconnect the handle by pressing on the projections 1355 and 2355 such that the side portions 1350 and 2350 are deflected inwardly and then pull the male element 350 out off the female element 450. Non-limiting examples of suitable material include wood, metals, and plastics. One skilled in the art will understand that when the handle is connected to the universal joint, the projections/recesses prevent at least temporarily the longitudinal, as well as, rotational movement of the male element and, as a result, movement of the handle relative to the female element and that the side portions/notched portions prevent the rotation of the handle relative to the female element.

In a preferred embodiment, the male element 350 comprises at least one but preferably two "lip portions" 3350 and 4350 for preventing the male element 350 from reaching too deeply within the female element 450. When the male element 350 is inserted within the female element 450 and the resilient protrusions 1355 and 2355 engage the openings 1455 and 2455, the lip portions 3350 and 4350 abut against the top of the female element 450. Among other benefits, the lip portions prevent the resilient protrusions 1355, 2355 from disengaging the openings 3350 and 4350 when a user applies downward pressure on the handle 30.

One skilled in the art will understand that the location of male and female elements can be inverted (i.e. the male connected to the universal joint and the female to the handle) and still provide the same benefits.

In addition to the benefits already enumerated, the previously described quick-disconnect mechanisms provide a lock and key feature to the cleaning implement which can be particularly beneficial when the strength of the handle is substantially non-homogeneous. An example of such a handle is provided infra.

III Handle.

As previously discussed, a cleaning implement 10 preferably includes a handle 30.

In one embodiment, the handle has a substantially non-homogeneous strength. By "substantially non-homogeneous strength" is it meant that the handle is more resistant to deformation or bending in a particular direction and consequently, that the Young modulus of the handle in a first direction is greater than the Young modulus of the handle taken in a second direction where the first direction is preferably perpendicular to the second direction. One skilled in the art will understand that, for example, the resistance to deformation of a hollow handle having a substantially circular cross-sectional shape and a substantially constant thickness is homogenous in the sense that the resistance to deformation or bending of this handle, and consequently its Young modulus, does not depend on the orientation or direction of the handle.

It has been observed that during a typical cleaning operation with a cleaning implement, the angle between the handle and the surface being cleaned can vary between about 10 and about 80 degrees. It has also been observed that it is typical for a user to only use one hand to clean floor surface with a cleaning implement (such as the SWIFFER® cleaning implement) and a disposable cleaning sheet (such as the SWIFFER® cleaning sheet). Without intending to be bound by any theory, it is believed that this "single-hand" use is due to the fact that very little force is required to maneuver the implement. It has been further observed that when a user wishes to remove or scrub tough stains with a cleaning implement such as the implement described in copending U.S. patent application Ser. No. 10/797,237 to Höfte et al., filed Mar. 11, 2004, or described in copending U.S. provisional patent application Ser. No. 60/499,851 to Goh et al., filed Sep. 3, 2003, both assigned to The Procter & Gamble Company, a user will naturally apply one hand at the top portion of the handle and the other hand about the middle portion of the handle. By positioning his or her hands in such a manner, the force applied by the user can cause the handle to deform and or bend. This "cleaning habit" and positioning of the hands result in a concentration of forces at the distal end of the handle and universal joint (i.e. the portion connecting the handle to the mop head) which can damage or even cause the connection between the handle and the universal joint to break.

A handle having a substantially non-homogeneous strength can be used to limit, and preferably to avoid, the deformation or bending of the handle when a user applies a force in a particular direction in order to "scrub" the surface being cleaned.

In one embodiment, the cross-sectional geometric shape of a handle having a substantially non-homogeneous strength has a width and a length such that the length is greater than the width. Non-limiting examples of suitable cross-sectional geometric shapes are shown in FIGS. 12-15.

Figure 15:
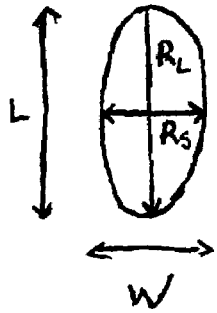
FIG. 15 is a cross-sectional view of another suitable handle.

In a preferred embodiment, a handle having a substantially non-homogeneous strength has a substantially eliptical shape as shown in FIG. 15. This eliptical shape can be defined by a small radius Rs and a large radius Rl. In one embodiment, the small radius Rs is between about 5 mm and about 30 mm, preferably between about 7 mm and about 20 mm, more preferably between about 9 mm and about 15 mm and the large radius Rl is between about 5 mm and about 40 mm, preferably between about 8 mm and about 25 mm, more preferably between about 10 mm and about 20 mm.

In one embodiment, the handle is attached or attachable to the mop head 20 of a cleaning implement 10 such that the large radius axis of the oval handle is substantially parallel to the X-X rotational axis of the universal joint which is itself substantially parallel to the longitudinal axis of the mop head as shown in FIG. 10.

Among over benefits, a handle having a non-homogeneous strength, which connected to a mop head such that the direction of the handle having the greatest Young modulus is substantially parallel to the longitudinal axis of the mop head allows a linear and/or coaxial transmission of the force applied to the handle to the mop head and, as a result, limits damage to the universal joint. An elliptical shaped handle is also beneficial in the sense that in does not include sharp edges, which could hurt the user's hands. In addition, an elliptical shaped handle provides an ergonomic grip allowing the user to hold the handle more comfortably.

In one embodiment, the handle 30 can be a telescopic handle. A telescopic handle allows a user to adjust the length of the handle as desired or required in order for example to clean hard to reach surfaces.

Figure 16:
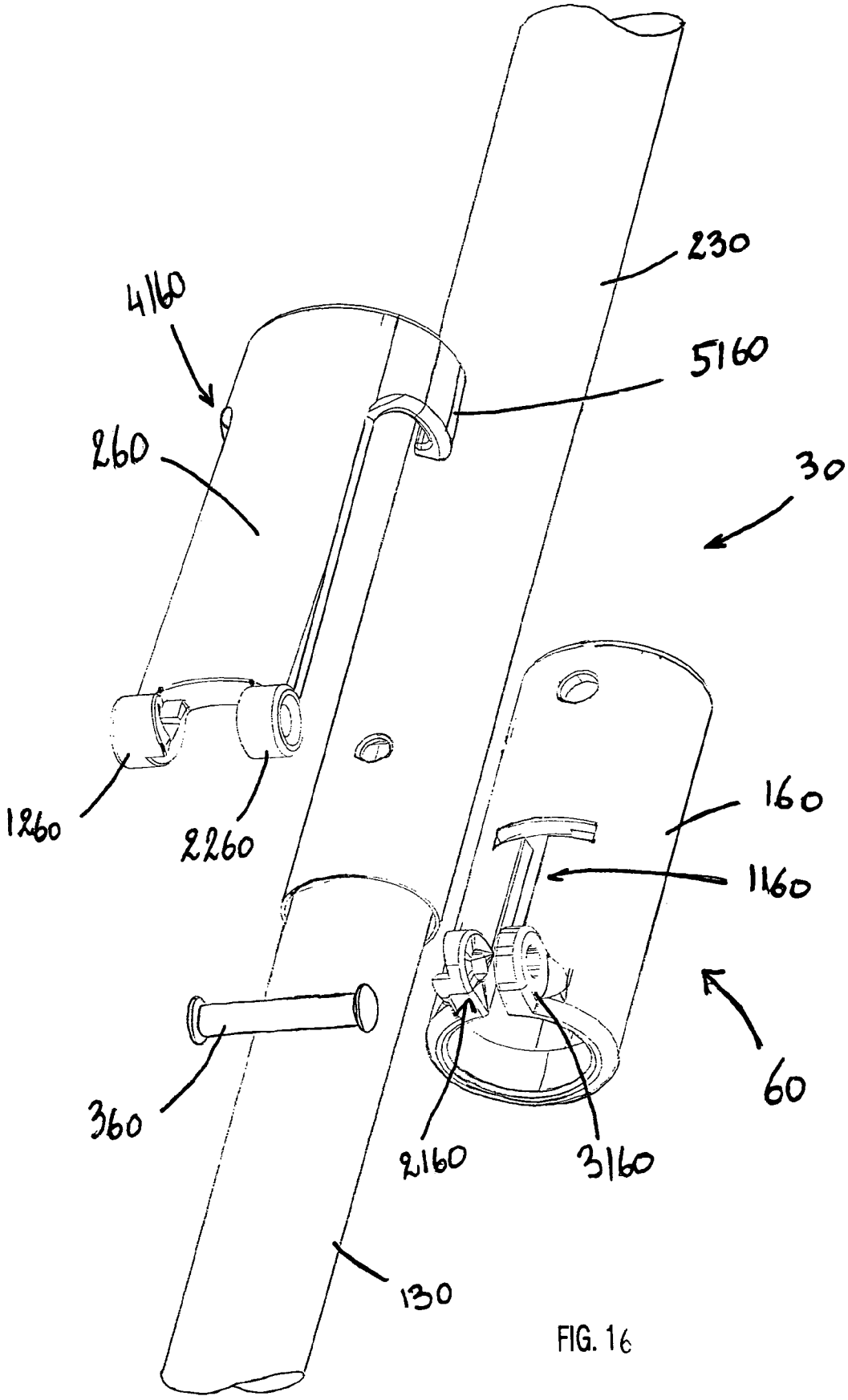
FIG. 16 is a partial isometric and exploded view of a suitable locking mechanism.

In one embodiment shown in FIG. 16, the telescopic handle 30 includes a first and a second handle segment 130 and 230 such that the first handle segment is slidably movable within the second handle segment 230. In one embodiment, the first handle segment 130 is controllably lockable within the second handle segment 230 via a locking mechanism 60 (shown in exploded view if FIG. 16). The locking mechanism 60 can be any locking mechanism known in the art and allowing a user to slide the first handle segment 130 within the second handle segment 230 at a desired location and lock the first segment 130 relative to the second segment 230. Non-limiting examples of locking mechanisms include resilient projections extending through an opening of the first segment and capable of engaging at least one of a plurality of openings of the second segment, and twist-lock mechanisms.

In one embodiment, the locking mechanism 60 is a "clinch-lock" mechanism. In one embodiment, the clinch-lock mechanism includes a grabbing member 160 having a proximal portion that is fixedly connected to a distal end of the second handle segment 230 and a lever member 260 operably connected to the grabbing member 160.

In one embodiment, the grabbing member 160 includes a longitudinal slit 1160 extending from the distal end of the grabbing member toward the proximal end of the grabbing member. In one embodiment, the grabbing member 160 comprises a first and a second transfer portion 2160 and 3160 located at the distal end of the grabbing member on each side of the slit 1160 and extending outwardly from the outer surface of the grabbing member.

In one embodiment, the lever member 260 includes a first and a second compressing portion 1260 and 2260 located at the distal end of the lever member 260 for imparting a compressive force to the first and second transfer portions 2160 and 3160. In a preferred embodiment, the lever member is pivotably connected to the grabbing member 160 via a pin 360 extending openings made through the first and second transfer portions 2160 and 3160, as well as the first and second compressing portions 1260 and 2260.

Figure 17:
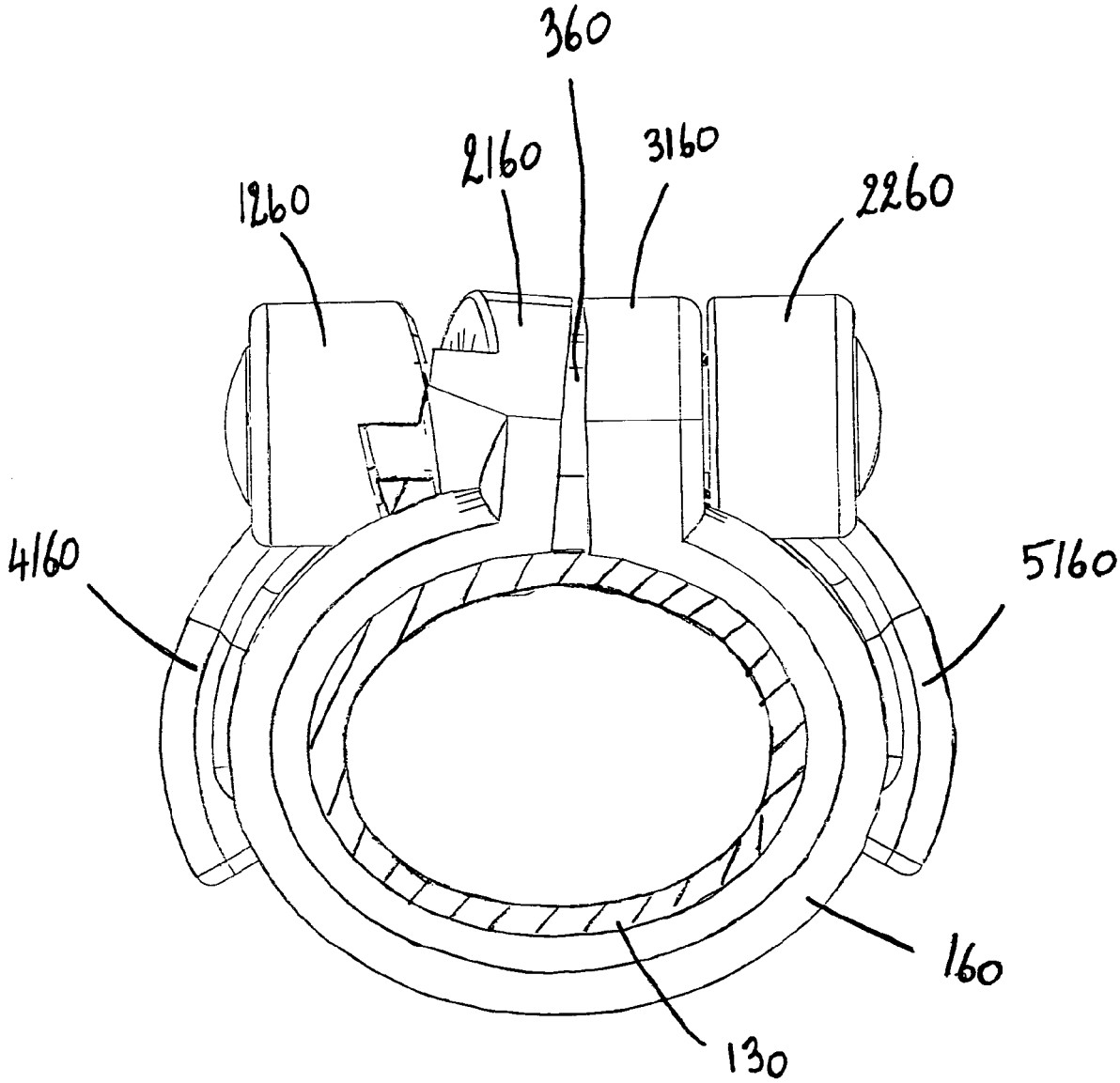
FIG. 17 is a cross-sectional view of the assembled locking mechanism of FIG. 16 shown in a locked position.

In one embodiment, the compressive portions 1260 and 2260, but preferably only one of the compressing portions 1260 or 2260 has an inner surface for engaging the corresponding outer surface of the transfer portion 2160 or 3160. In a preferred embodiment, the inner surface of the compressing portion 1260 or 2260 and the outer surface of the corresponding transfer portion 2160 or 3160 both have an helical shape such that when the level member 260 is adjacent to the grabbing member, i.e. in a first position as shown in FIG. 17, the first and second transfer portions are compressed. The inward compression of the first and second transfer portions causes the distal portion of the grabbing member to grab frictionally the first handle segment 130 thereby locking the first handle segment 130 relative to the second handle segment 230. One skilled in the art will understand that when the first and second transfer portions 2160 and 3160 are compressed, the space created by the slit 1160 is reduced.

Figure 18:
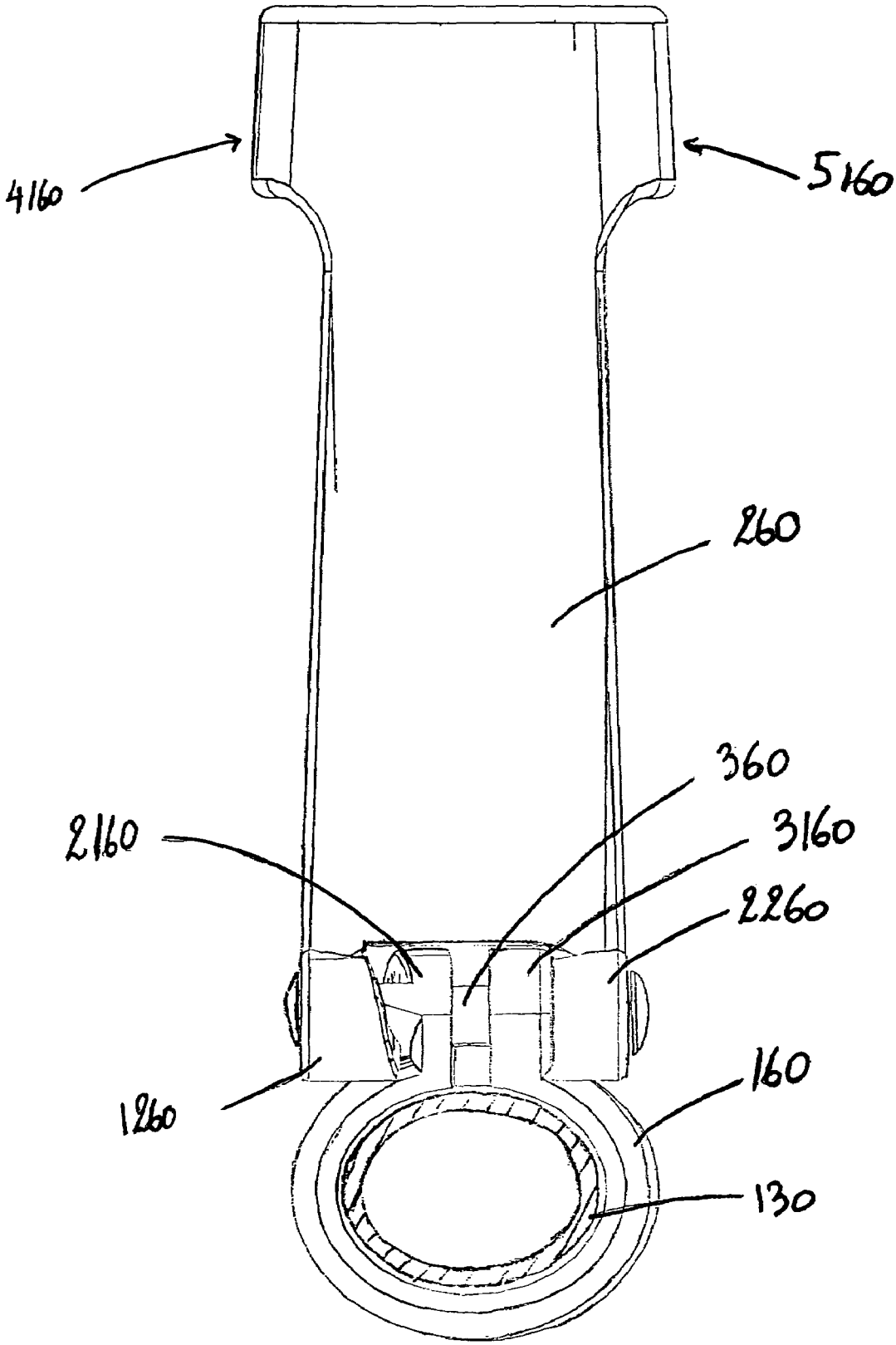
FIG. 18 is a cross-sectional view of the assembled locking mechanism of FIG. 16 shown in an unlocked position.

When the lever member 260 is in a second position as shown in FIG. 18, the inner circumference of the grabbing member 160 is greater than the outer circumference of the first handle segment 130 creating a space between the grabbing member and the first handle segment 130. As a result, the first handle segment 130 is capable of slidably moving within the second handle segment 230 to a location chosen by the user.

In one embodiment, the lever member 260 include a first and a second clipping portion 4160 and 5160 for temporarily and/or controllably maintaining the lever member 260 attached to the second handle section 230 when the lever member is in the first position as shown in FIGS. 16 and 17. In a preferred embodiment, the first and second clipping portions 4160 and 5160 are substantially deformable and resilient such that they can deflect outwardly when the lever member 260 is moved from the first to the second position and vice versa.

Among other benefits, the previously described clinch-lock mechanism allow a user to controllably lock or move the first handle segment 130 within the second handle segment 230 by placing the lever member in the first or second position. In a preferred embodiment, the grabbing member is made of a deformable and resilient material such that the distal end of the grabbing member 160 returns to its original shape when the lever member 260 is moved from the first to the second position (i.e. from locked to unlocked).

In a preferred embodiment, the first and second handle segment have a substantially non-homogeneous strength has previously discussed.

In a preferred embodiment, the cross-sectional shape of first and second handle segments 130 and 230, as well as, the cross-sectional shape of the grabbing member 160 are substantially elliptical as previously discussed.

Among other benefits, the clinch-lock mechanism 60 previously described makes it possible to have a telescopic handle having a substantially non-homogeneous strength and especially an oval cross-sectional shape. One skilled in the art will understand that by its nature, a twist-lock mechanism is typically used with telescopic handles having a circular cross-sectional shape since it requires a rotation in order to "squeeze" or lock the handle segments. In addition, a clinch-lock mechanism allows a user to lock a first handle segment relative to a second handle segment at any location of the first handle segment within the second handle segment. In order to provide multiple locking positions, a projection type mechanism would require a numerous openings made through the second handle section. It can be desirable to avoid making multiple openings in a handle section as these openings tend to weaken the handle strength, in particular if the cleaning implement having this handle is used to remove tough stains.

Figure 19:
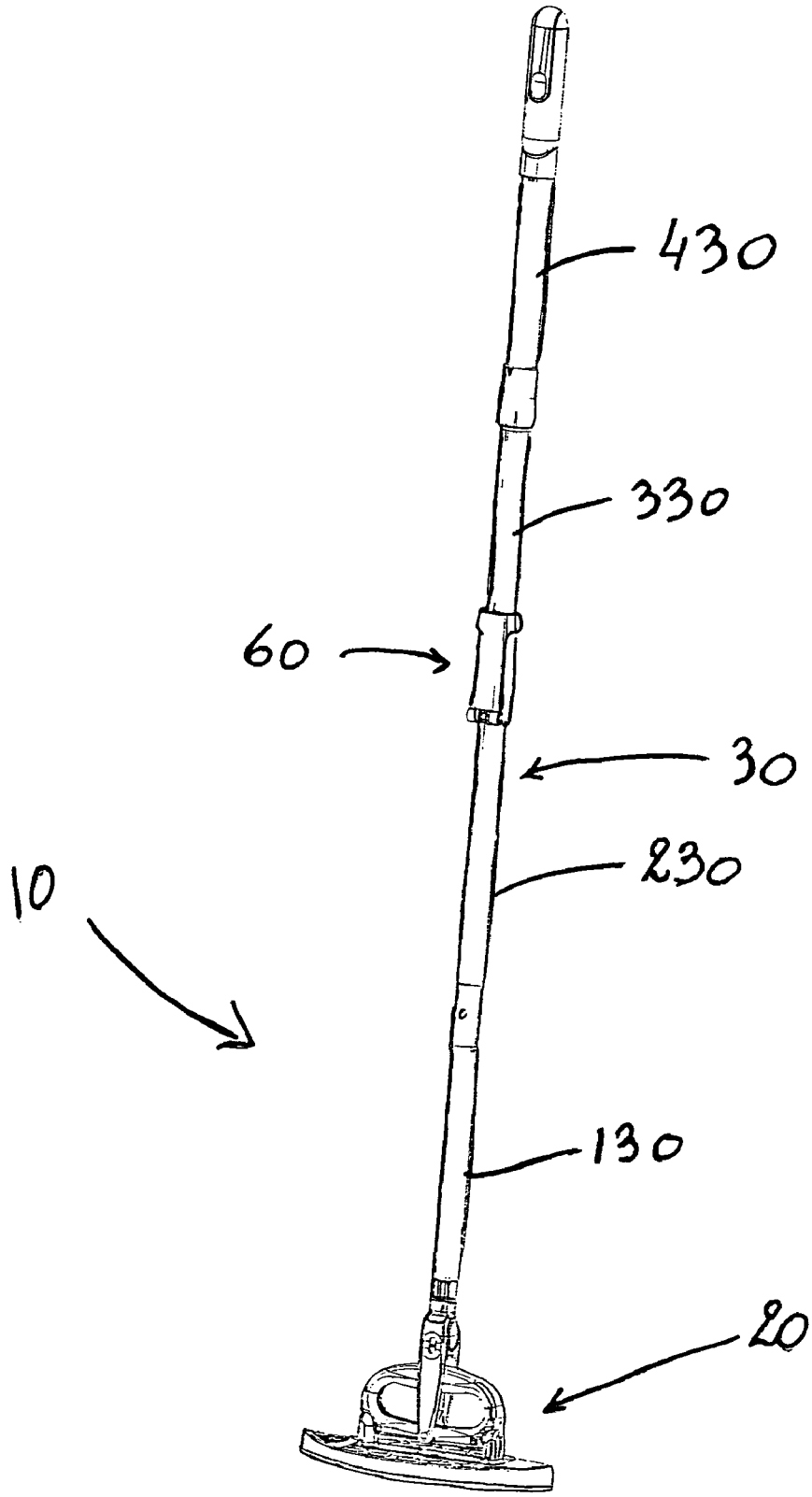
FIG. 19 is an isometric view of a cleaning implement having a fully extended telescopic handle.
Figure 20:
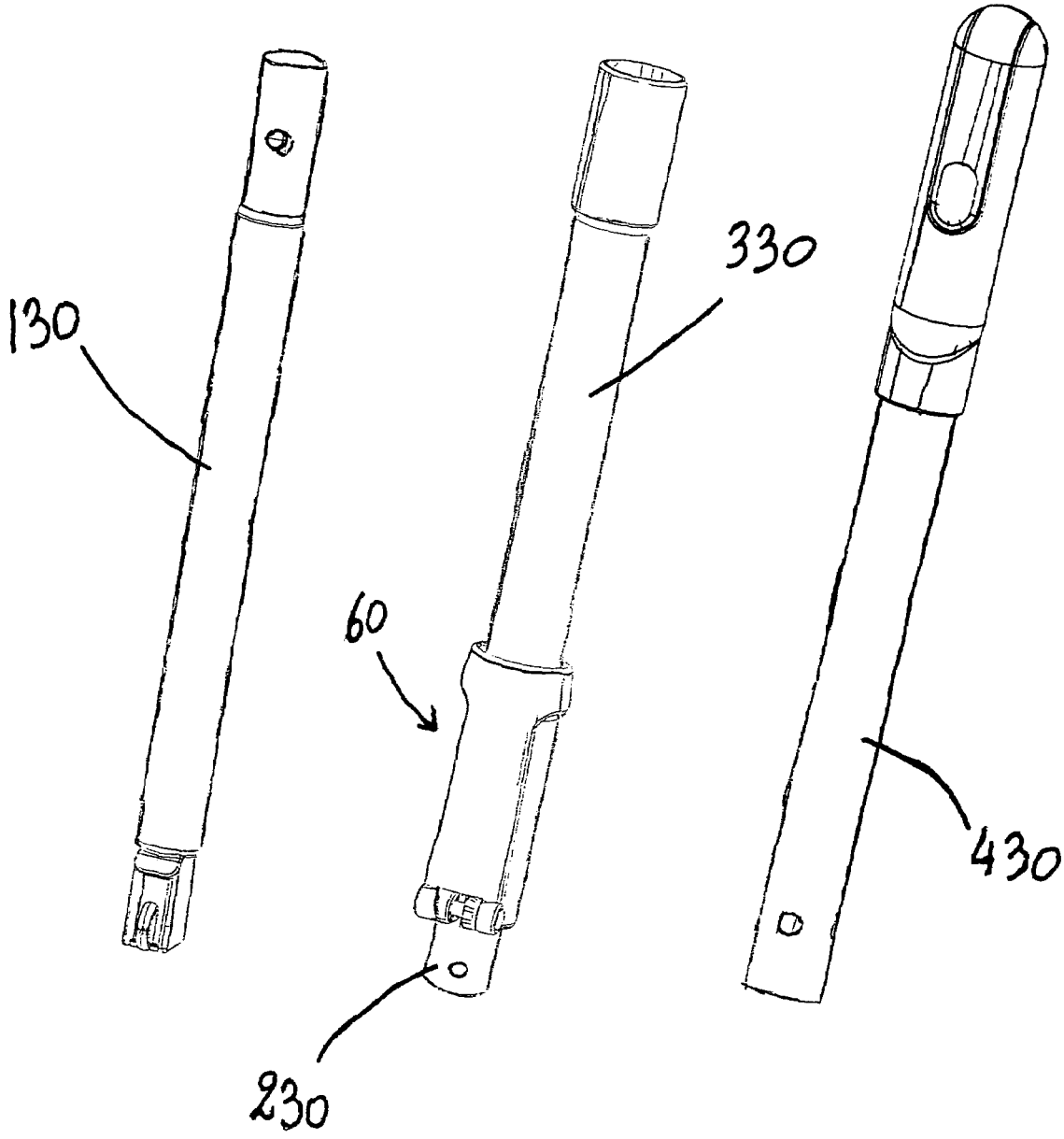
FIG. 20 is an isometric view of suitable handle segments for providing a telescopic handle.

In one embodiment shown in FIGS. 19 and 20, the handle 30 includes more than two handle segments. In one embodiment, the handle includes a first handle segment 130, a second handle segment 230, a third handle segment 330 and a fourth handle segment 430. A fully extended and assembled view of the telescopic handle 30 connected to a mop head is shown in FIG. 19 and a partially unassembled view of the telescopic handle 30 is shown in FIG. 20.

In one embodiment, the distal end of first handle segment 130 is connectable, preferably releasably connectable to the mop head 20 and a proximal end of first handle segment 130 is connectable, preferably releasably connectable to the distal end of the second handle segment 230. The proximal end of the second handle segment 230 is connectable, and preferably pre-connected to the distal end of the third handle segment 330. The proximal end of the third handle segment 330 is connectable, preferably fixedly connectable to the distal end of the fourth handle segment 430.

In one embodiment, the outer circumference of the first and second handle segments 130 and 230 is smaller than the inner circumference of at least the third, but preferably both the third and fourth handle segments 330 and 430. One skilled in the art will understand that a user can easily connect the first handle segment to the second handle segment, then connect the third to the fourth handle segments and then slidably move the first and second handle segments with the third and fourth handle segments in order to provide a telescopic handle. Any of the previously discussed locking mechanism, but preferably the previously described clinch-lock mechanism can be used to allow a user to controllably/selectively position the second (or both the first and second) handle segment within the third (or within both the third and fourth) handle segment.

It will be understood that the previously described universal joint and/or telescoping handle can be used with a variety of cleaning implement and still provide the same benefits. Non-limiting examples of cleaning implement include "wet cleaning implement" which carry their own source of detersive fluid.

IV Cleaning Kit.

In one embodiment, a cleaning implement including any of the features previously described can be sold as a cleaning kit in a package.

In one embodiment, the cleaning kit includes a mop head, first, second, third and fourth handle segments for providing a cleaning implement having a telescopic handle. In a preferred embodiment, the cleaning kit also includes at least one disposable cleaning wipe that can be releasably attached to the mop head by a user when removed from the package.

In a preferred embodiment, the mop head is not connected to the distal end of the first handle segment, the proximal end of the first handle segment is not connected to the distal end of the second handle segment, the second handle segment is slideably connected to the third handle segment, a substantial portion of the second handle segment is located within the third handle segment, and the proximal end of the third handle segment is not connected to distal end of the fourth handle segment when all these elements are stored in the package.

"Typical" telescopic handles are packaged in a pre-assembled and collapsed form, and, as a result, are dictating the minimum length of the package. One skilled in the art will understand that even when these telescopic handles a collapsed, the length of the collapsed handle is great than the length of one individual handle segment. Because the handle segments of the telescoping pole of the invention are placed in the package in a unassembled form, the size of the package used to store the cleaning kit can be reduced. Among other benefits, smaller packages allows to reduce the shipping cost of the cleaning kit, it also allows a store to place more cleaning kits on its shelves and it is more "shopper-friendly" in the sense that it is easier to carry and occupies less volume.

After having removed all the elements of the cleaning kit from the package, a user can easily assemble the cleaning implement and its telescopic handle by connecting the mop head the to first handle segment, the first handle segment to the second handle segment and the third handle segment to the fourth handle segment.

V. Package.

Figure 21:
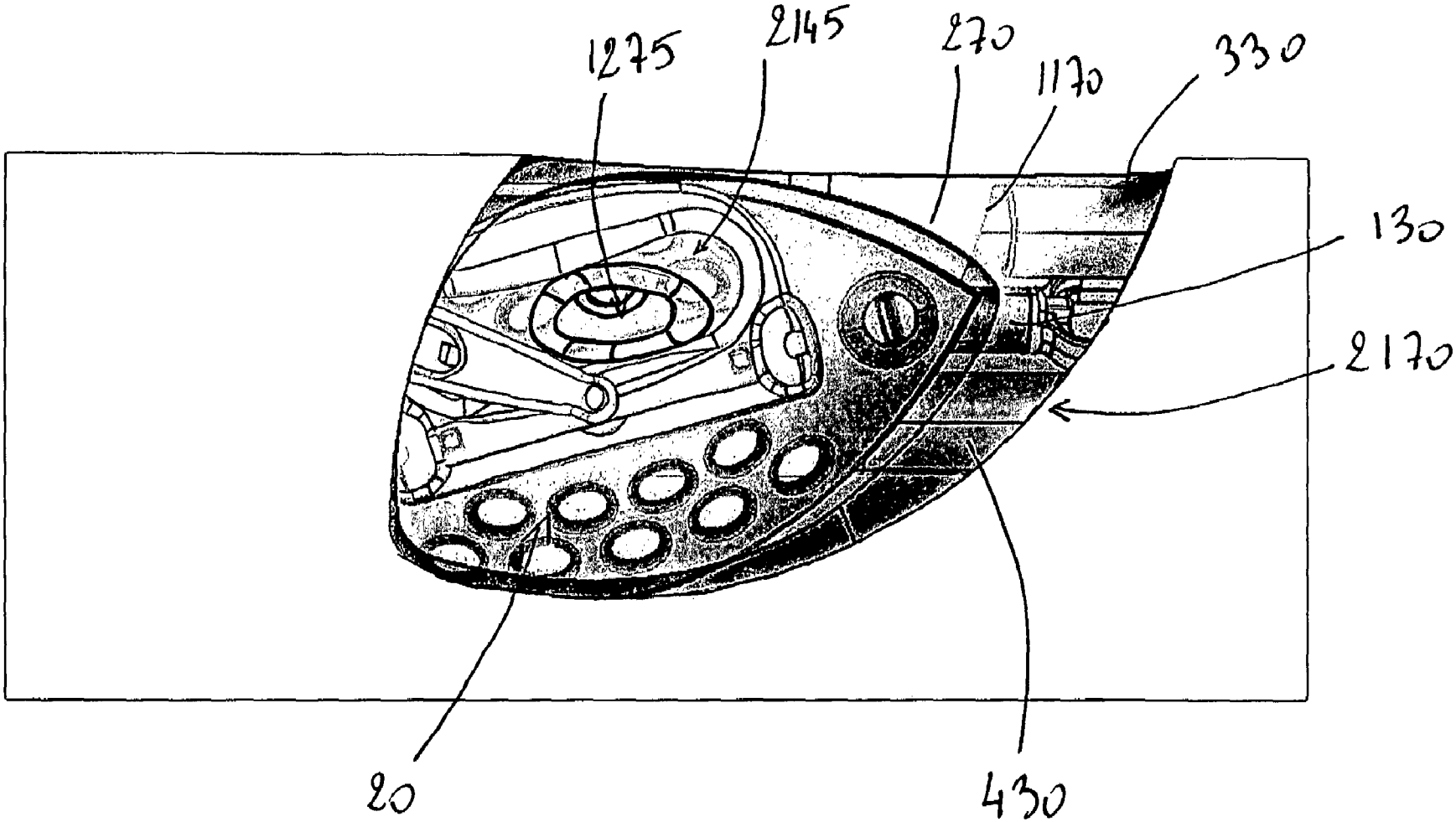
FIG. 21 is a top view of a package containing a cleaning implement.

In one embodiment shown in FIG. 21, the cleaning implement can be stored in a package 70 including a box 170 and a retaining element 270 located within the box 170.

In one embodiment, the sides of the box 170 are substantially rectangular and the body element can be made of cardboard that is preferably recyclable.

Figure 22:
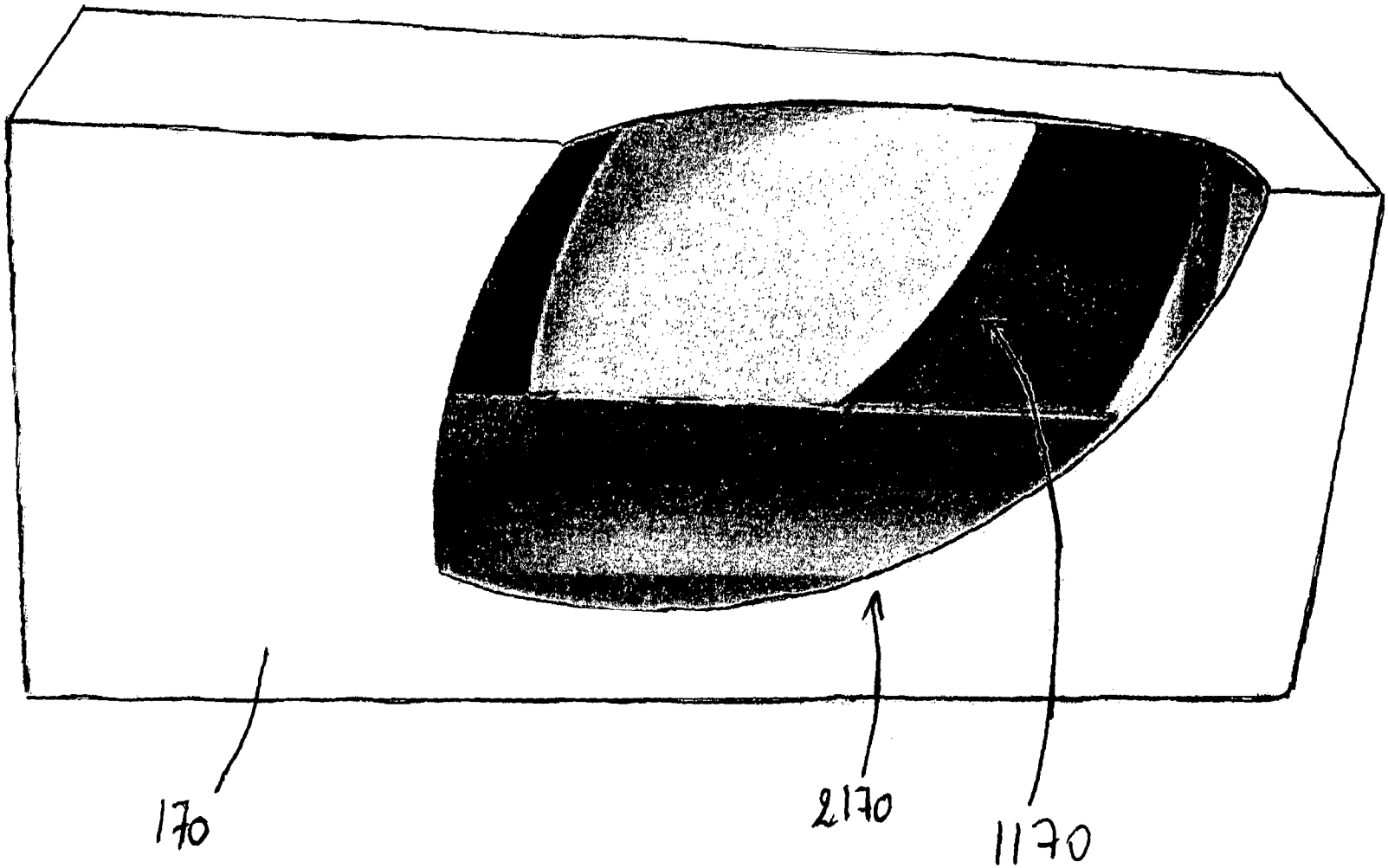
FIG. 22 is an isometric view of the box of the package shown in FIG. 21.

FIG. 22 shows a perspective view of the box 170 without the retaining element 270. The box 170 can have an inner compartment 1170 for maintaining the handle segments 130, 230, 330 and 430 in place within the box 170.

In one embodiment, at least one side of the body portion 170 includes an opening or "window" 2170 which allows a potential purchaser and future user to see the cleaning implement and especially the mop head through this window as shown in FIG. 21.

In one embodiment, the retaining element 270 is a made of plastic which formed, preferably thermoformed in order to create a three-dimensional shape or texture in order to match and/or conform to the contour of at least a portion of the mop head of the implement. When the mop head is placed against the matching three-dimensional surface of the retaining member, movement of the mop head within the package is substantially limited and preferably prevented. The retaining element can be thermoformed via any process known in the art such as via a heat-press imparting the desired shape to a sheet of plastic material.

Figure 23:
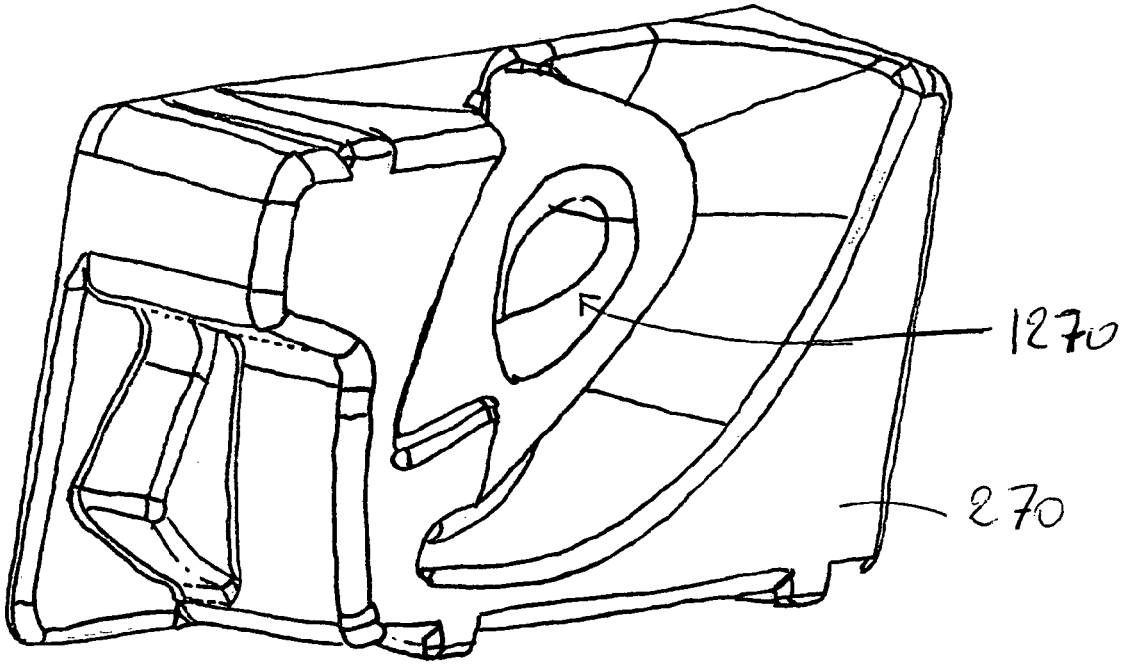
FIG. 23 is a front isometric view of the retaining element of the package shown in FIG. 21.
Figure 24:
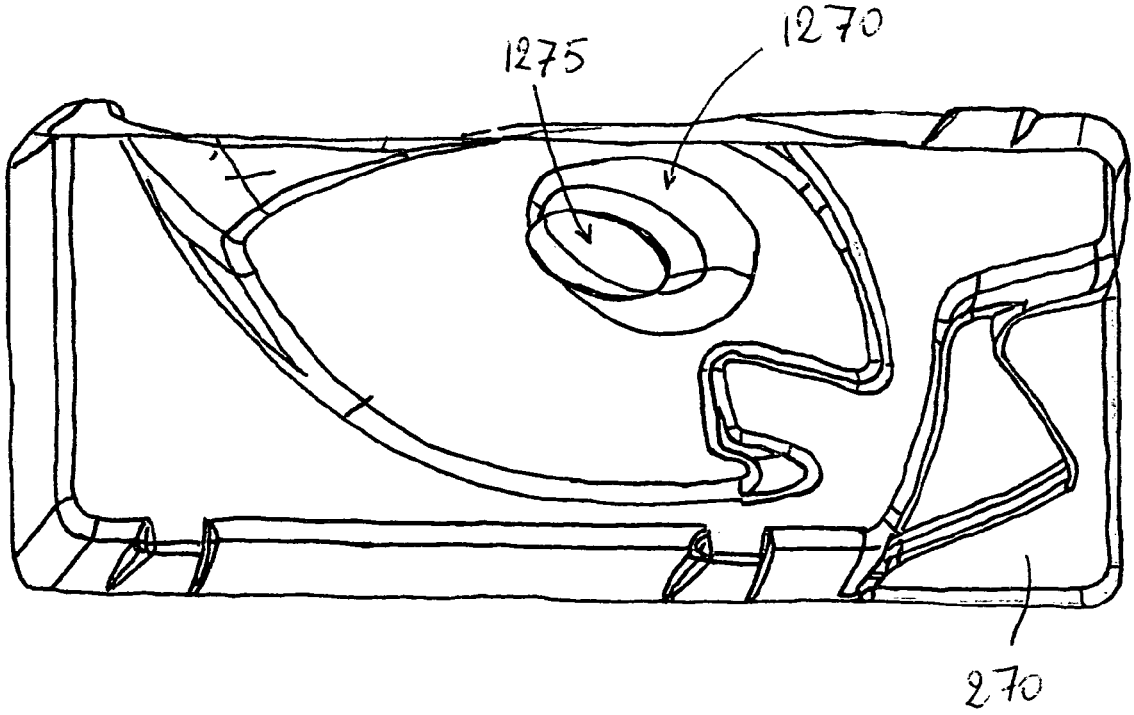
FIG. 24 is a back isometric view of the retaining element of FIG. 23.

FIGS. 23 and 24 show respectively a front and a back perspective view of the retaining element 270.

In one embodiment, the retaining element 270 includes a recessed portion 1270 having a wall extending towards the inside of the box 170. The mop head is preferably placed in the package such that the handgrip portion is substantially parallel to the top surface of the mop head. The recessed portion 1170 preferably fits within at least a portion of the space 2145 (i.e. in between the handgrip portion 2140 and the support portion 1140 of the mop head 20), such that movement of the mop head into the package 70 is substantially prevented.

In this embodiment, the retaining element 270 is preferably located in between the mop head and the side(s) of the box including the opening 1170 in order to prevent the mop head or any other element of a cleaning kit from passing through the opening 1170. In a preferred embodiment, at least the portion of the retaining element 270 that is adjacent to the opening 1170 which is substantially transparent in order to let the potential purchaser and future user see the implement.

In a preferred embodiment, the recessed portion 1270 includes an opening 1275 for allowing a person to feel with his or her fingers at least some of the physical properties of the implement, especially the physical properties of the mop head 20. In a preferred embodiment, at least a portion of the mop head is accessible through the opening 1275 of the recessed portion 1270. Non-limiting examples of physical properties that can be "felt" by a potential purchaser through this opening include texture or patterns which are part of the mop head, as well as, material compressibility, deformability or rigidity of a portion of the cleaning implement, especially of a portion of the mop head.

The potential purchaser can be instructed to "feel" and/or "experience" these physical properties by providing specific instructions in the form of words, drawings and/or arrow(s) pointing towards the recessed portion 1270, which are located on a portion of the package adjacent to the recessed portion 1270.

In addition, the recessed portion 1270 either alone but preferably in combination with this opening forms a grip allowing a user to take, to hold and/or to move the package around in a convenient manner.

Any of the previously described components forming the universal joint and the quick-disconnect mechanism can be made of any suitable material known in the art such as metal(s), wood(s), plastic(s), reinforced materials or any combinations thereof. It will be understood that handle segments can be connected via any mechanism know in the art such as spring clips engaging and extending through openings made through each handle segment. In addition, the distal and/or proximal portions of the handle segments can be swaged or tapered inwardly or outwardly in order to connect two handle segments.

As discussed supra, a first handle segment is slideably movable within a second handle segment while the first handle segment is connectable to the mop head. It is also contemplated that the same benefits can be achieved when a first handle segment is connectable to a mop head and a second handle segment is slideably moveable within the first handle segment. In this embodiment, the proximal portion of the first handle segment can include a locking mechanism for controllably locking the second handle segment relative to the first handle segment.

The described cleaning implements are preferably used with a disposable cleaning substrate. However, one skilled in the art will understand that these implements can also be advantageously used with a reusable substrate material such as a sponge or any other absorbent material. Non-limiting examples of suitable disposable cleaning substrates include "dry cleaning sheets" which are used to remove particulate matters (such as dust, crumbs, hair, lint, allergens) from a surface to be cleaned, "dry absorbent cleaning wipes or pads" which are used for wet cleaning of a surface by applying a cleaning solution and then wiping the surface with the wipe or pad to remove the dirty solution, or "pre-moistened cleaning wipes or pads" which are impregnated with a cleaning solution. The disposable cleaning substrate can comprise a single layer or multiple layers of substrate material. The disposable cleaning substrate is made preferably of a nonwoven material. Non-limiting examples of suitable cleaning substrates for uses with the cleaning implement of the present invention are described in copending U.S. provisional patent application Ser. No. 60/526,501 to Sherry et al., filed Dec. 3, 2003, and copending U.S. provisional patent application Ser. No. 60/526,628 to Lynde et al., filed Dec. 3, 2003, both assigned to The Procter & Gamble Company.

As previously discussed, it is understood that the mop head can have any shape or size and that it can be made of any suitable material depending on the desired cleaning operation.

A cleaning substrate can be attached to the mop head of any of the previously described cleaning implement via any method or mechanism know in the art. In a one embodiment, the mop head 20 includes at least one slitted structure 320 such as the one described in U.S. Pat. No. 6,305,046 to Kingry et al. issued Oct. 23, 2001, and assigned to The Procter & Gamble Company. Other non-limiting examples of suitable mechanisms for retaining a cleaning substrate include hook and/or loop fasteners, clamps, buttons, adhesive or any combinations thereof. The mechanism for retaining a cleaning substrate can be located on the top surface of the mop head, and/or on the side surface of the mop head and/or at the bottom surface of the mop head and still provide the same benefits.

As previously discussed, a cleaning implement 10 includes an elongated handle 30 which is preferably one of a telescopic handles previously described. However, it will be understood that the handle 30 can be any other handle known in the art and still provide at least some of the benefits.

The foregoing description of the preferred embodiments of the invention has been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto and which should be construed as broadly as the prior art will permit.

What is claimed is:

1. A cleaning implement for use with a cleaning substrate, comprising:

a mop head;

a handle; and a universal joint rotatably connected to said mop head and having a first and second rotational axis wherein said universal joint comprises an upper member comprising two leg portions rotatably connected to a lower member such that said lower member is located in between said two leg portions and wherein said lower member is ergonomically shaped to form a handgrip portion such that a user can hold said handgrip portion with one hand and clean a surface with said mop head when said handle is not connected to said universal joint and wherein said lower member further comprises a support, wherein between said handgrip portion and said support defines a space which allows a user to insert his or her fingers to hold said handgrip; and wherein said handle is connected to said universal joint.

2. The cleaning implement of claim 1, wherein said universal joint further comprises:

an upper member rotatably connected to said lower member about said second rotational axis.

3. The cleaning implement of claim 2 wherein said lower member comprises a support portion connected to said handgrip portion and wherein said upper member is rotatably connected to said support portion.

4. The cleaning implement of claim 3 wherein said lower member rotates about said first rotational axis when said upper member is in a first position and wherein said lower member cannot rotate about said first rotational axis when said upper member is in a second position.

5. The cleaning implement of claim 4 wherein said upper member comprises a first and a second leg portion having a space in between.

6. The cleaning implement of claim 5 wherein said mop head has a top and a bottom surface and at least one protrusion extending upwardly from said top surface.

7. The cleaning implement of claim 6 wherein said upper member is in said second position when said protrusion is located between said first and second leg portions of said upper member.

8. The cleaning implement of claim 7 wherein said upper member is temporarily locked in said second position such that said upper member cannot rotate about said second rotational axis.

9. The cleaning implement of claim 8 wherein the length of said protrusion is greater than the inner distance between said first leg portion and said second leg portion.

10. The cleaning implement of claim 9 wherein said handle is releasably connected to said upper member.

11. The cleaning implement of claim 1 further comprising a disposable cleaning substrate wherein said disposable cleaning substrate is releasably attached to said mop head.

12. A cleaning implement for use with a disposable cleaning substrate comprising:

a mop head;

a handle; and a universal joint having a first and a second rotational axis, wherein said universal joint is connected to said mop head and comprises an upper member comprising two leg portions rotatably connected to a lower member having a support portion and a handgrip portion wherein said handgrip portion is located in between said two leg portions, wherein said upper member is directly connected to said support portion and wherein said handgrip portion is configured such that a user can hold said handgrip portion with one hand and clean a surface with said mop head when said handle is not connected to said universal joint, wherein between said handgrip portion and said support defines a space which allows a user to insert his or her fingers to hold said handgrip; and wherein said handle is an elongated handle having a proximal and a distal end, wherein said distal end comprises a male element for releasably engaging a female element of said upper member of said universal joint.

13. The cleaning implement of claim 12 wherein said male element comprises a first and a second side portion for engaging and sliding within a corresponding first and second notched portion of said female portion.

14. The cleaning implement of claim 13 wherein said first side portion comprises a projection for engaging a corresponding recess located within said first notched portion and wherein said projection extends outwardly from the inner surface of said first side portion.

15. The cleaning implement of claim 14 wherein said first and second side portions deflect outwardly when said male element engages said female element.

16. The cleaning implement of claim 14 wherein rotational movement and longitudinal movement of said male element relative to said female element are temporarily prevented when said projection extends within said recess.

17. The cleaning implement of claim 14 wherein said male element further comprises a central projection for engaging a central recess of said female element.

18. The cleaning implement of claim 12 wherein said universal joint is temporarily locked to prevent rotation of the universal joint about said first and said second rotational axis.

19. The cleaning implement of claim 12 further comprising a disposable cleaning substrate removably attached to said mop head.

20. The cleaning implement of claim 12 wherein said male element comprises at least a resilient side portion for releasably engaging and extending through an opening of said female element when said male element is located within said female element.

21. The cleaning implement of claim 20 wherein said male element comprises a second resilient side portion have for releasably engaging and extending through a second opening of said female element when said male element is located within said female element.

22. A cleaning implement for use with a cleaning substrate, comprising:

a mop head;

a handle; and a universal joint connected to said mop head and having a first and a second rotational axis wherein said universal joint comprises an upper member comprising two leg portions and a rotation-tempering mechanism for providing improved directional control and wherein said upper member is rotatably connected to a lower member such that said lower member is located in between said two leg portions and wherein said lower member comprises a support and a handgrip portion such that a user can hold said handgrip portion with one hand and clean a surface with said mop head when said handle is not connected to said universal joint and wherein between said handgrip portion and said support defines a space which allows a user to insert his or her fingers to hold said handgrip; and wherein said handle is connected to said universal joint.

23. The cleaning implement of claim 22 wherein said rotation-tempering mechanism comprises at least one frictional element for limiting the ability of said universal joint to rotate about said first rotational axis.

24. The cleaning implement of claim 23 wherein said rotation-tempering mechanism comprises at least one frictional element for limiting the ability of said universal joint to rotate about said second rotational axis.

25. The cleaning implement of claim 23 wherein said universal joint is able to rotate about said first rotational axis when a minimum torque of between about 0.0005 Nm and about 0.1 Nm is applied to said handle in a direction substantially perpendicular to said first rotational axis.

26. The cleaning implement of claim 25 wherein said universal joint is able to rotate about said second rotational axis when a minimum torque of between about 0.0005 Nm and about 0.1 Nm is applied to said handle in a direction substantially perpendicular to said second rotational axis.

27. The cleaning implement of claim 26 wherein mop head comprises a longitudinal axis and wherein said first rotational axis is substantially parallel to said longitudinal axis.

28. The cleaning implement of claim 27 wherein said at least one frictional element for limiting the ability of said universal joint to rotate about said first rotational axis is made of rubber.

29. A cleaning implement for use with a cleaning substrate, comprising:

a mop head;

a universal joint rotatably connected to said mop head and having a first and second rotational axis wherein said universal joint comprises a lower member which includes a support wherein said lower member is ergonomically shaped to form a handgrip portion wherein between said handgrip portion and said support defines a space which allows a user to insert his or her fingers to hold said handgrip; and a female element connected to or formed with an upper member of said universal joint used to connect a handle to said upper member of said universal joint.

* * * * *